US010326242B2

(12) United States Patent
Valenti

(10) Patent No.: US 10,326,242 B2
(45) Date of Patent: Jun. 18, 2019

(54) RJ COMMUNICATION CONNECTORS

(71) Applicant: Panduit Corp., Tinley Park, IL (US)

(72) Inventor: Joshua A. Valenti, Ferndale, MI (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/844,706

(22) Filed: Dec. 18, 2017

(65) Prior Publication Data

US 2018/0109038 A1 Apr. 19, 2018

Related U.S. Application Data

(63) Continuation of application No. 15/581,197, filed on Apr. 28, 2017, now abandoned.

(60) Provisional application No. 62/329,641, filed on Apr. 29, 2016.

(51) Int. Cl.

| | |
|---|---|
| ***H01R 13/64*** | (2006.01) |
| ***H01R 13/6461*** | (2011.01) |
| ***H01R 24/64*** | (2011.01) |
| *H01R 107/00* | (2006.01) |
| *H01R 13/66* | (2006.01) |

(52) U.S. Cl.

CPC ..... *H01R 13/6461* (2013.01); *H01R 24/64* (2013.01); *H01R 13/6658* (2013.01); *H01R 2107/00* (2013.01)

(58) Field of Classification Search

CPC ..... H01R 13/6461

See application file for complete search history.

(56) References Cited

U.S. PATENT DOCUMENTS

| | | | | |
|---|---|---|---|---|
| 5,899,770 | A * | 5/1999 | Ezawa | H01R 24/64 439/418 |
| 6,113,400 | A * | 9/2000 | Martin | H01R 13/6466 439/418 |
| 6,244,906 | B1 * | 6/2001 | Hashim | H01R 13/6464 439/676 |
| 6,354,865 | B1 * | 3/2002 | Bogese | H01R 13/6658 439/418 |
| 6,561,838 | B1 * | 5/2003 | Blichfeldt | H01R 13/6463 439/418 |
| 6,592,397 | B2 * | 7/2003 | Pocrass | H01R 13/7175 439/218 |
| 6,764,333 | B2 * | 7/2004 | Pocrass | H01R 9/035 439/418 |
| 7,048,572 | B1 * | 5/2006 | Ting | H01R 4/2404 439/418 |
| 7,140,906 | B2 * | 11/2006 | Takahashi | H01R 24/64 439/418 |
| 7,201,618 | B2 * | 4/2007 | Ellis | H01R 13/6477 439/676 |
| 7,823,281 | B2 * | 11/2010 | Caveney | H05K 1/028 29/857 |
| 8,197,286 | B2 * | 6/2012 | Larsen | H01R 4/2429 439/620.21 |

(Continued)

*Primary Examiner* — Ross N Gushi

(74) *Attorney, Agent, or Firm* — Christopher S. Clancy; James H. Williams; Christopher K. Marlow

(57) ABSTRACT

A communications system includes a modified RJ45 plug and a modified RJ45 jack. The communications system allows for backwards connectivity and interoperability with other RJ45 jacks and plugs by having two potential contact points on each the plug and the jack that may serve as an electrical interface between different types of connectors.

7 Claims, 47 Drawing Sheets

(56) References Cited

U.S. PATENT DOCUMENTS

| | | | | |
|---|---|---|---|---|
| 8,647,146 | B2 * | 2/2014 | Bopp | H01R 13/6461 439/404 |
| 8,894,446 | B2 * | 11/2014 | Feldner | H01R 12/727 439/676 |
| 8,992,247 | B2 * | 3/2015 | Aekins | H01R 24/64 439/418 |
| 9,698,534 | B2 * | 7/2017 | Bopp | H01R 13/6461 |
| 2007/0015414 | A1 * | 1/2007 | Denovich | H01R 13/6633 439/676 |
| 2007/0015417 | A1 * | 1/2007 | Caveney | H01R 13/6658 439/676 |
| 2008/0146093 | A1 * | 6/2008 | Caveney | H01R 13/6658 439/890 |
| 2010/0048040 | A1 * | 2/2010 | Straka | H05K 1/0228 439/55 |
| 2010/0151707 | A1 * | 6/2010 | AbuGhazaleh | H01R 13/6272 439/76.1 |
| 2011/0117788 | A1 * | 5/2011 | Hsieh | H01R 24/64 439/660 |
| 2014/0226455 | A1 * | 8/2014 | Schumacher | H01R 13/6461 370/201 |
| 2017/0222375 | A1 * | 8/2017 | Cui | H01G 4/38 |

* cited by examiner

RJ COMMUNICATION CONNECTORS

CROSS-REFERENCE TO RELATED APPLICATIONS

This application is a continuation of, and claims the benefits of priority to, U.S. patent application Ser. No. 15/581,197, filed on Apr. 28, 2017, which claims the benefits of priority to U.S. Provisional Application No. 62/329,641, filed on Apr. 29, 2016, the entireties of which are incorporated herein by reference.

FIELD OF INVENTION

The present invention generally relates to the field of telecommunication, and more specifically, to connectors, such as modified RJ45 plugs and/or jacks, which provide connectivity between communication cables and telecommunication equipment.

BACKGROUND

A large portion of today's telecommunication occurs over connectivity components which employ modular connectors such as, for example, RJ45 plugs and jacks. These modular connectors are commonly used in conjunction with twisted-pair cables which provide a reliable means for transmitting electronic data over small, medium, and large distances.

To maintain a level of interoperability, both the connectors and cables must adhere to well-known standards. For instance, the commonly referred-to RJ45 connector is standardized as the IEC 60603-7 8 position 8 contact (8P8C) modular connector with different categories of performance. With respect to cables, ANSI/TIA defines categories of unshielded twisted pair cable systems, with different levels of performance in signal bandwidth, attenuation, crosstalk, insertion loss, return loss, etc. Generally speaking, the increasing category numbers correspond to cable systems suitable for higher rates of data transmission. However, with the increased rates of transmission often comes the difficulty of meeting the performance specifications defined by the TIA specifications while staying within the physical constraints defined by the IEC standard.

One particular area of concern that becomes prominent in high speed communication systems is the ability to effectively cancel crosstalk. It is well known that per communication standards, plugs are typically tuned to produce some levels of crosstalk (usually referred to as "offending crosstalk") and jacks are designed to produce an approximately equivalent amount of opposite crosstalk (usually referred to as "compensating crosstalk"). The net effect is that offending crosstalk is substantially cancelled when the plug and jack are mated together. With RJ45 connectors, crosstalk compensation can generally be simplified by shortening the effective distance between the crosstalk in the plug and the crosstalk compensation in the jack. Shortening of this distance simplifies the jack crosstalk compensation by reducing the phase delay between the crosstalk in the plug and the opposite polarity crosstalk compensation in the jack. If the physical distance between the plug crosstalk and jack crosstalk compensation converged to the same point in time and had equivalent magnitudes, theoretically there would be no residual crosstalk over all frequency ranges. Since phase delay is a function of frequency (increasing with frequency) and an RJ45 jack typically needs to be tuned for a range of frequencies (e.g., 1 to 500 MHz for CAT6A), reduction of the above-mentioned phase delay tends to translate into a jack that is able to operate at an increased bandwidth. Conversely, jacks operating at increased frequencies or within increased frequency ranges must reduce the phase delay in order to effectively reduce or cancel the plug crosstalk. However, achieving such reduction in distance can be difficult in view of the current standards.

For example, referring to FIG. 1 which illustrates a cross-section view of an exemplary conventional RJ45 plug 20 mated with a conventional RJ45 jack 25, IEC-60603-7:2010 defines the preferred electrical mating point between an RJ45 male and female connector. In particular, it specifies that:

- a plug contact 30 height ($K_2$) from the bottom surface of the plug 20 to the top of the mating interface is in the range of 6.15 mm to 5.89 mm (0.242" to 0.232");
- a plug contact 30 radius ($J_2$) at a preferred electrical mating point is in the range of 0.64 mm to 0.38 mm (0.025" to 0.015"),
- a plug contact depth ($C_2$) from the front plug stop is in the range of 0.46 mm to 0.03 mm (0.018" to 0.001");
- a distance between the contact point and plug comb clearance point 35 (the point at which PICs (plug interface contacts) 40 are not constrained within plug combs 45 of plug housing in the rearward direction) is in the range of 0.635 mm to 3.175 mm (0.025" to 0.125"); and
- a distance between the contact point and plug comb clearance point 52 (the point at which plug interface contacts (PICs) 40 are not constrained within plug combs 45 of plug housing in the forward direction) is in the range of 0.635 mm to 3.175 mm (0.025" to 0.125").

As a result of these and other limitations, the electrical mating point location between PICs (plug interface contacts) 40 of the jack 25 and plug contacts 30 of plug 20 is denoted, in FIG. 1, as 55. This point 55 is approximately in the IEC-60603-7:2010 preferred electrical mating point location.

The distances outlined above define a theoretical minimum distance a signal must travel to escape the boundaries of an RJ45 plug assembly 20. This is important as this distance adds a time delay which results in the aforementioned phase shift between the crosstalk in the RJ45 plug assembly 20 and the compensation in the RJ45 network jack 25, thereby limiting the effectiveness of the jack compensation.

Thus, there continues to be a need for improved plug and jack designs which help reduce the distance between the plug and the jack crosstalk while still maintaining compatibility with defined standards.

SUMMARY

Accordingly, at least some embodiments of the present invention are directed towards devices, systems, and methods which employ communication connectors designed to reduce the distance between the plug and the jack crosstalk while still maintaining compatibility with defined standards.

In an embodiment, the present invention is a communication system that includes a modified RJ45 plug and a modified RJ45 jack. The modified RJ45 plug has two potential contact points that may serve as an electrical interface between the jack's plug interface contacts (PICs) and the plug's contacts. The first contact point is in the IEC-60603-7 preferred electrical mating point location, and allows for backwards connectivity and interoperability with other RJ45 female connectors (jacks). The second contact point is designed to be activated when the modified RJ45 plug is mated with the modified RJ45 jack. The modified RJ45 jack has two distinct surfaces on the PICs such that one surface meets the IEC-60603-7 preferred electrical mating point location and allows for backwards connectivity and interoperability with conventional RJ45 male connectors (plugs). The second contact surface is designed to be activated when the modified RJ45 jack is mated with the modified RJ45 plug.

These and other features, aspects, and advantages of the present invention will become better-understood with reference to the following drawings, description, and any claims that may follow.

DETAILED DESCRIPTION

Figure 2:
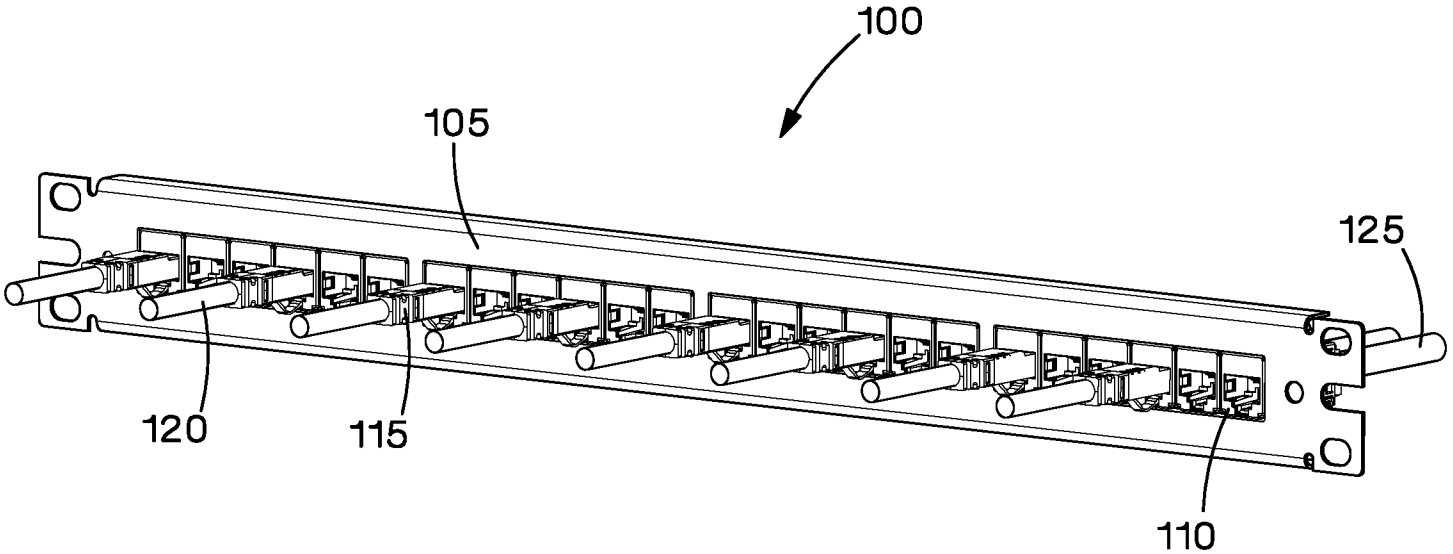
FIG. 2 is a communication system according an embodiment of the present invention.

An exemplary embodiment of the present invention is illustrated in FIG. 2, which shows a communication system 100, which includes a patch panel 105 with modified RJ45 jacks 110 and corresponding modified RJ45 plugs 115. Respective cables 120 are terminated to plugs 115, and respective cables 125 are terminated to jacks 110. Once a plug 115 mates with a jack 110 data can flow in both directions through these connectors. Although the communication system 100 is illustrated in FIG. 2 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 100 can further include cabinets, racks, cable management and overhead routing systems, and other such equipment.

Figure 3:
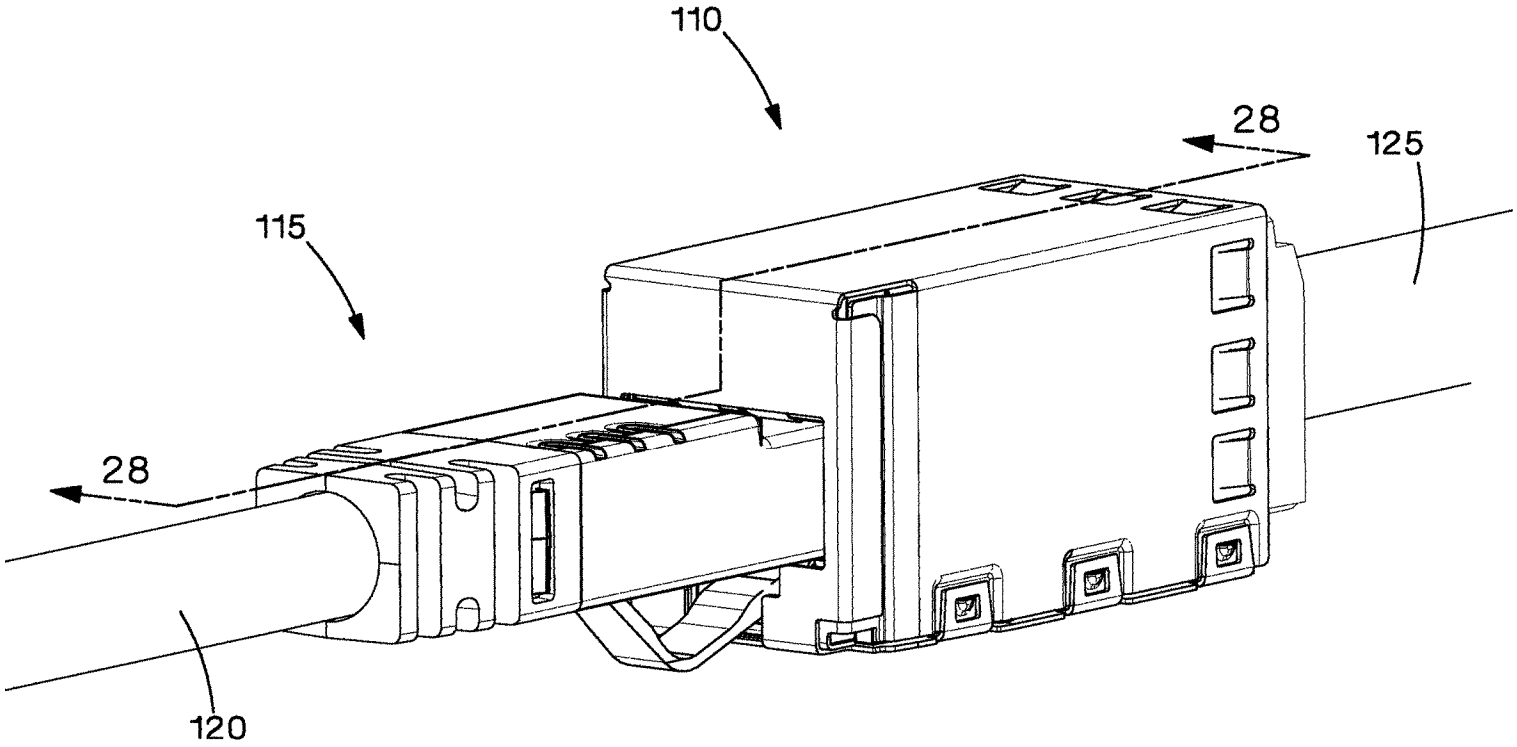
FIG. 3 is an isometric view of a modified RJ45 network jack mated with a modified RJ45 network plug according to an embodiment of the present invention.
Figure 4:
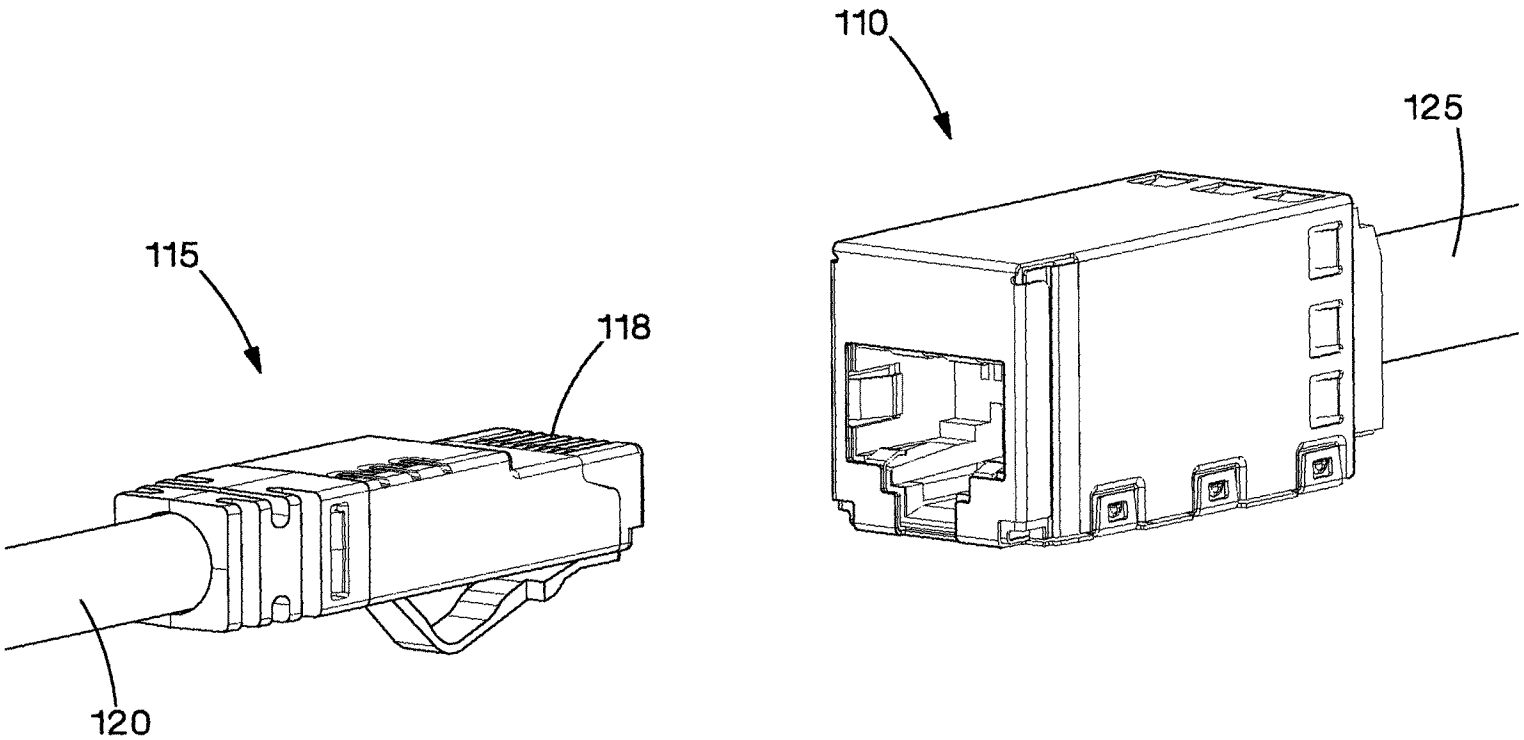
FIGS. 4-6 are isometric views of the modified RJ45 jack and the modified RJ45 plug of FIG. 3 in an unmated state.
Figure 5:
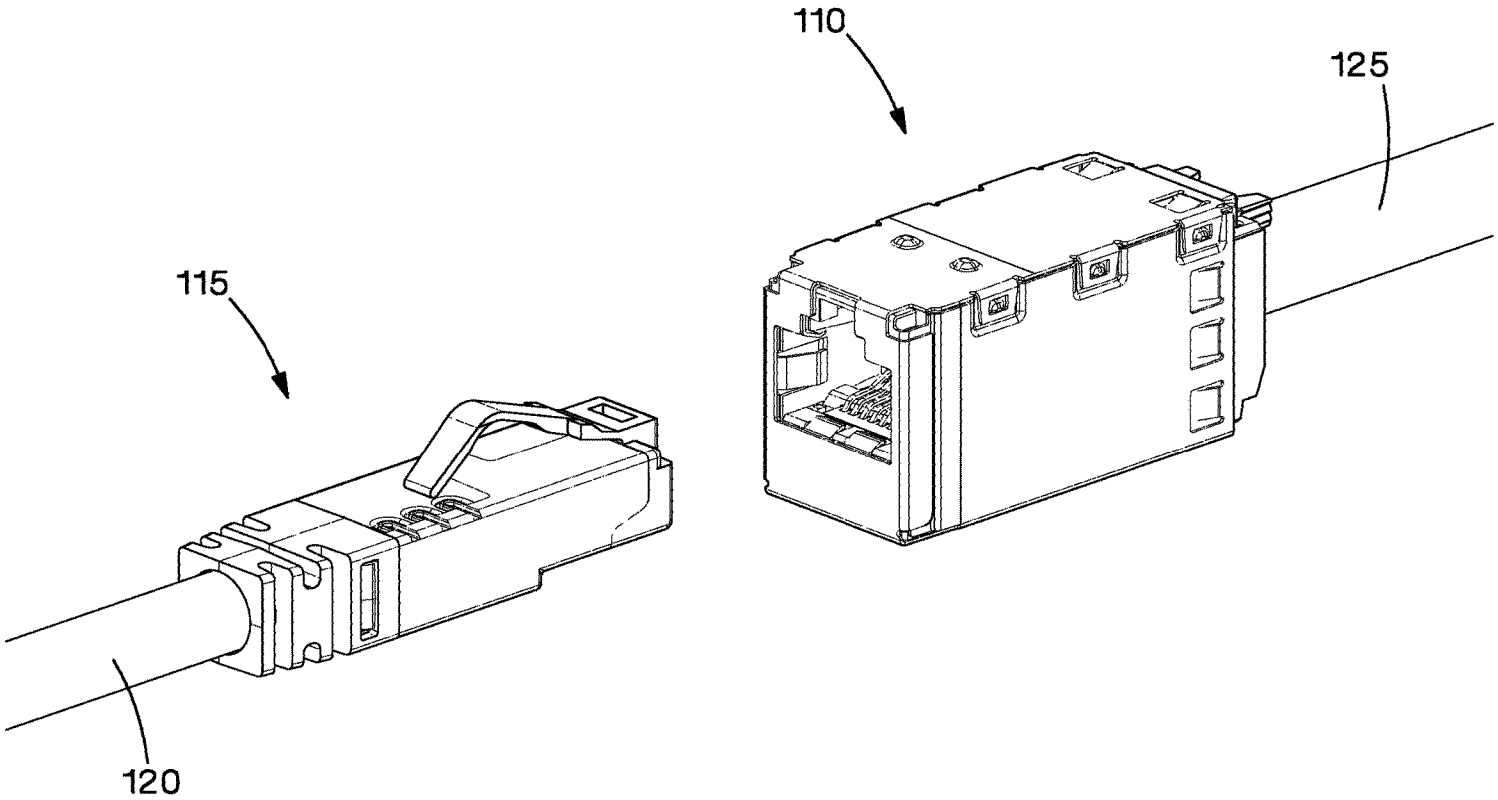
Figure 6:
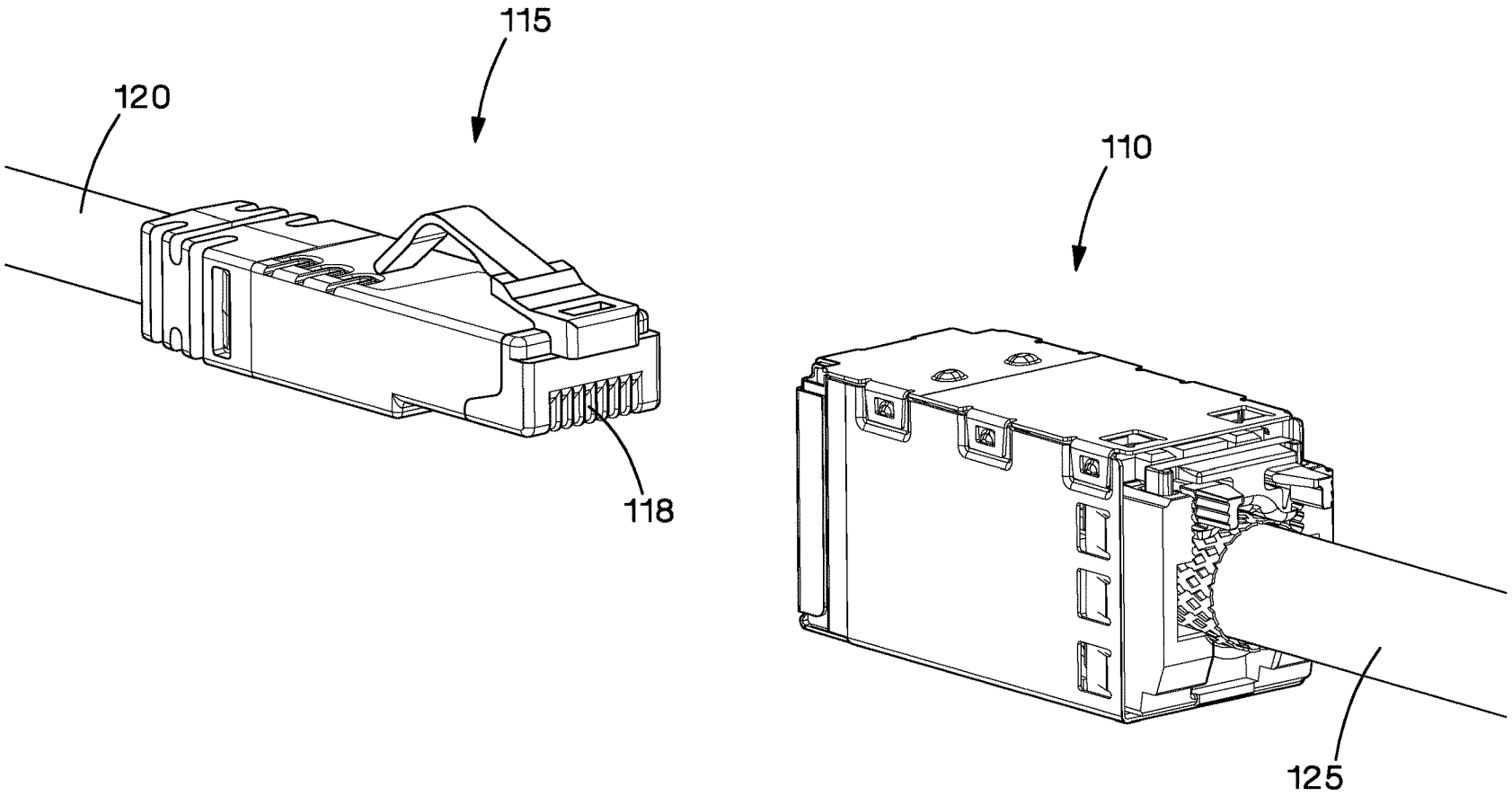

With the patch panel 105 removed, FIG. 3 illustrates the modified jack 110 and the modified RJ45 plug 115 in a mated configuration, and FIGS. 4-6 illustrate the jack 110 and the RJ45 plug 115 in an unmated configuration with FIG. 5 being rotated 180° about the central axis of cable 125 relative to FIG. 4, and FIG. 6 illustrating a rear isometric view relative to FIGS. 4 and 5.

Figure 7:
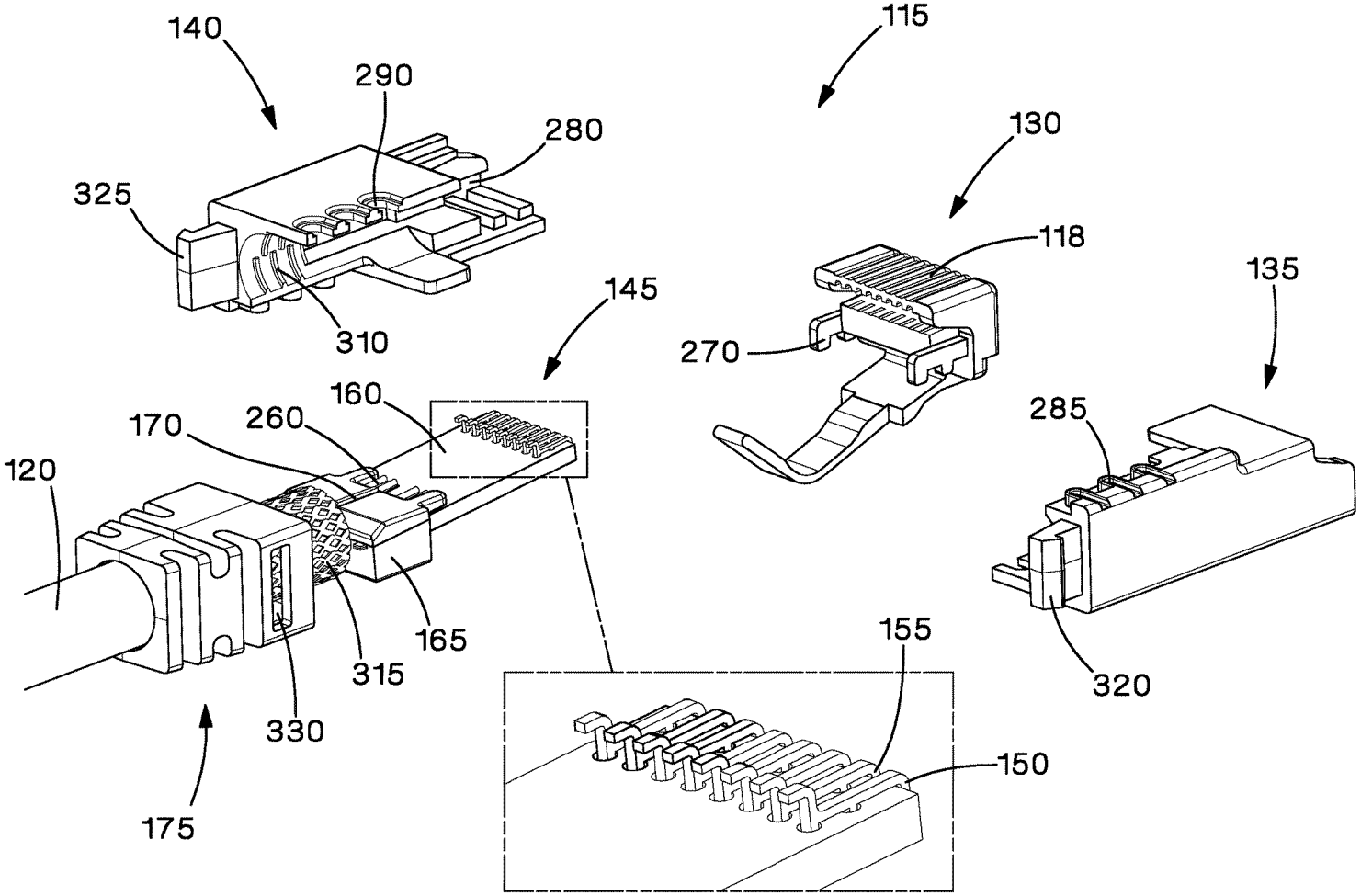
FIGS. 7-9 are isometric exploded views of a modified RJ45 plug according to an embodiment of the present invention.
Figure 8:
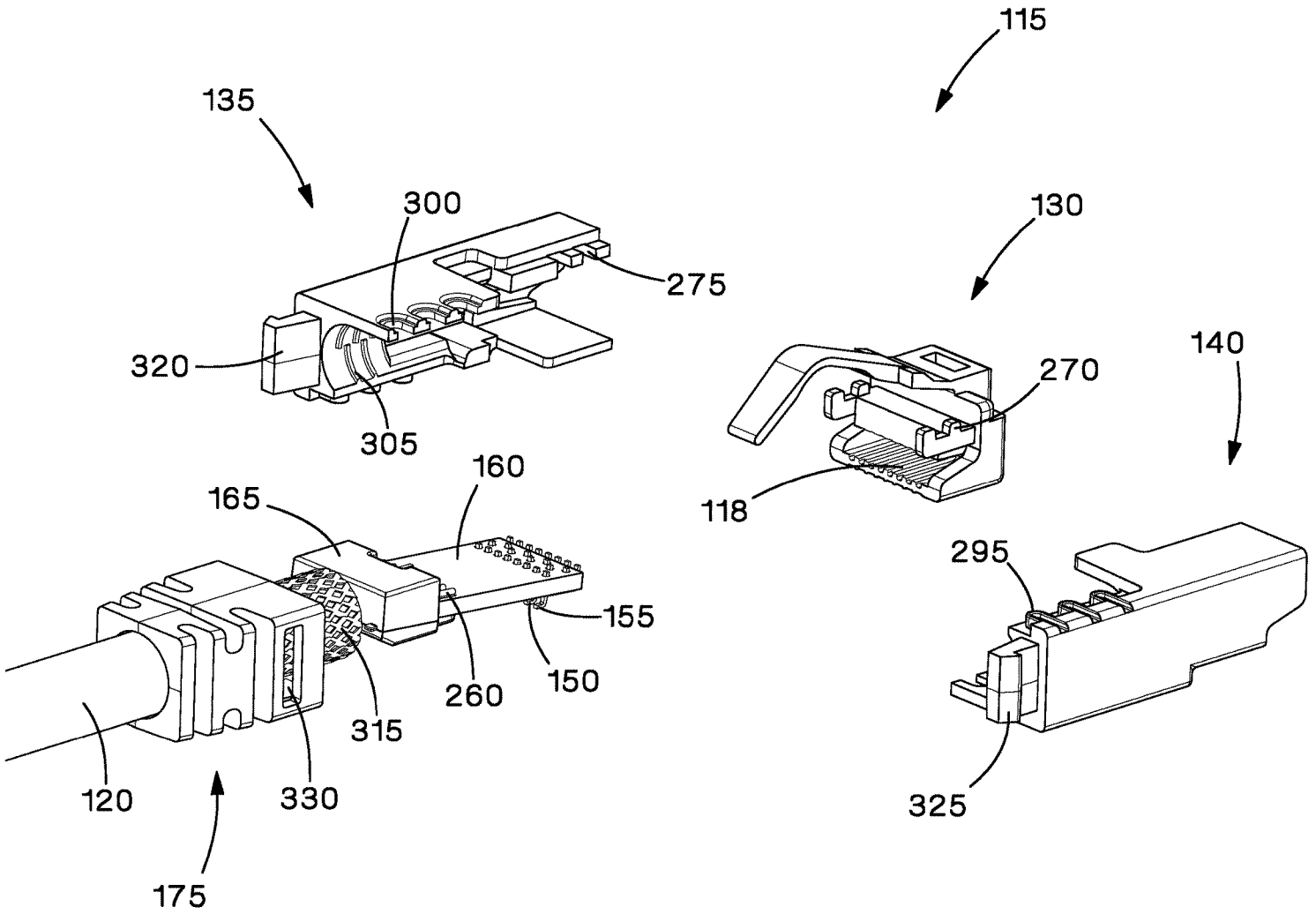
Figure 9:
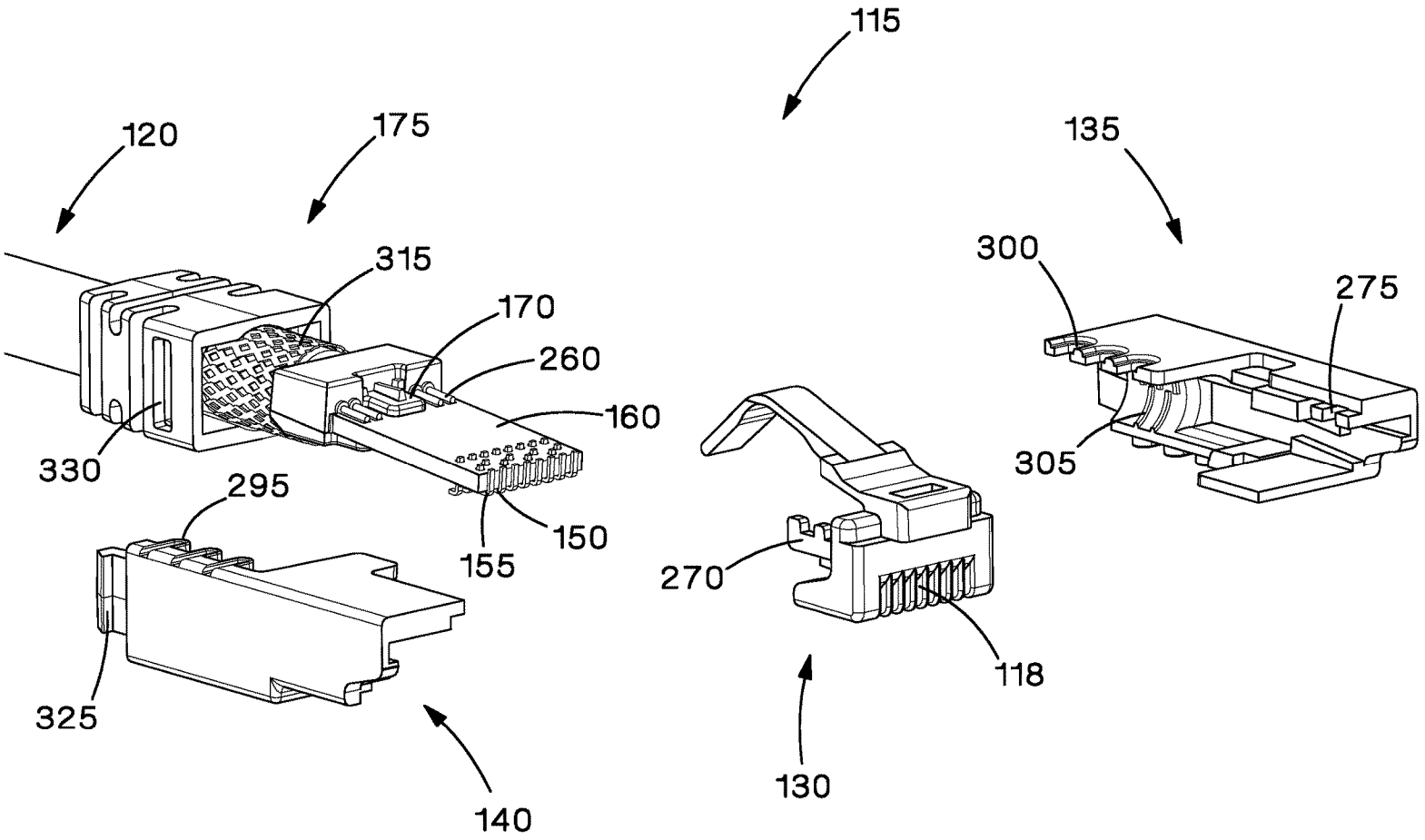
Figure 10:
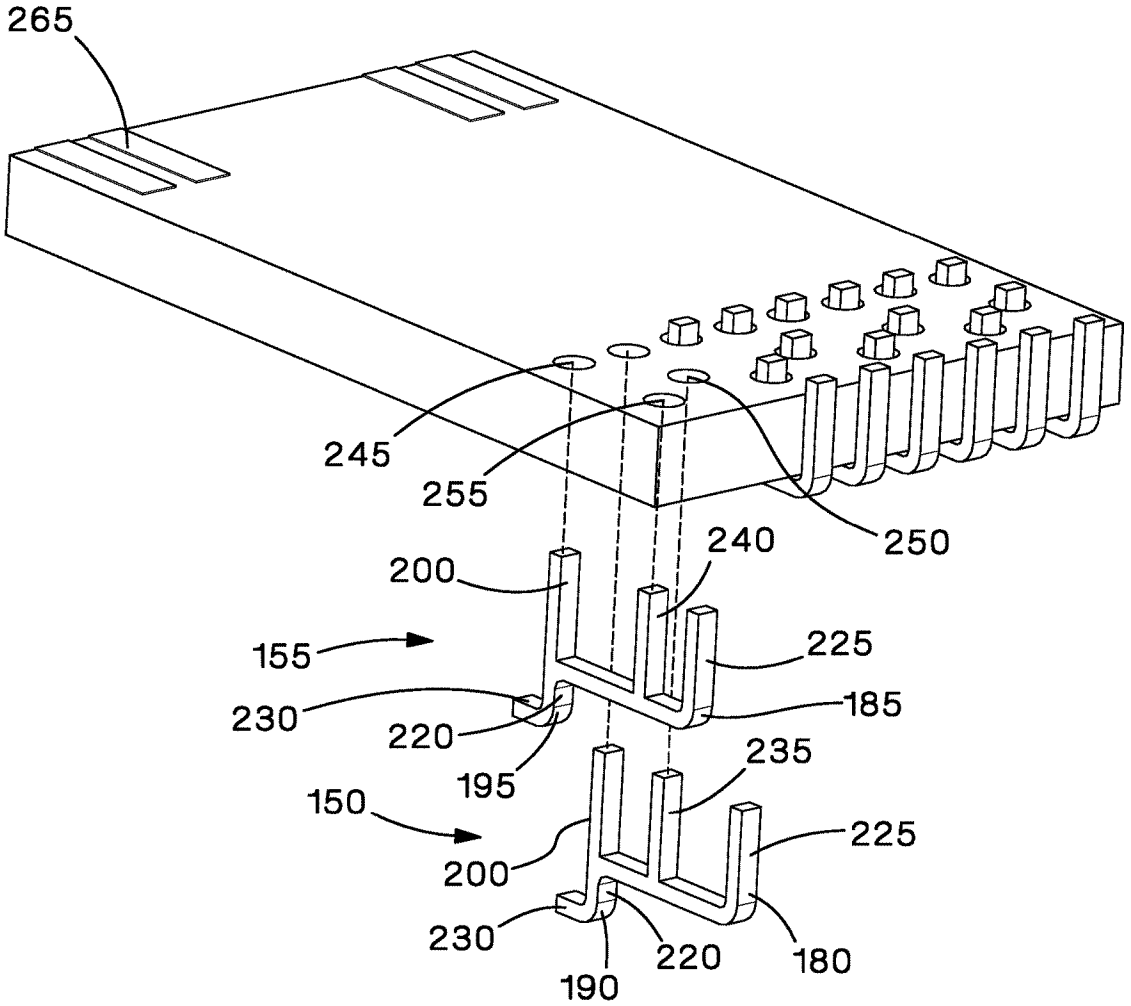
FIGS. 10-11 are isometric views of an embodiment of plug contacts and a plug printed circuit board (PCB) used in a modified RJ45 plug.
Figure 11:
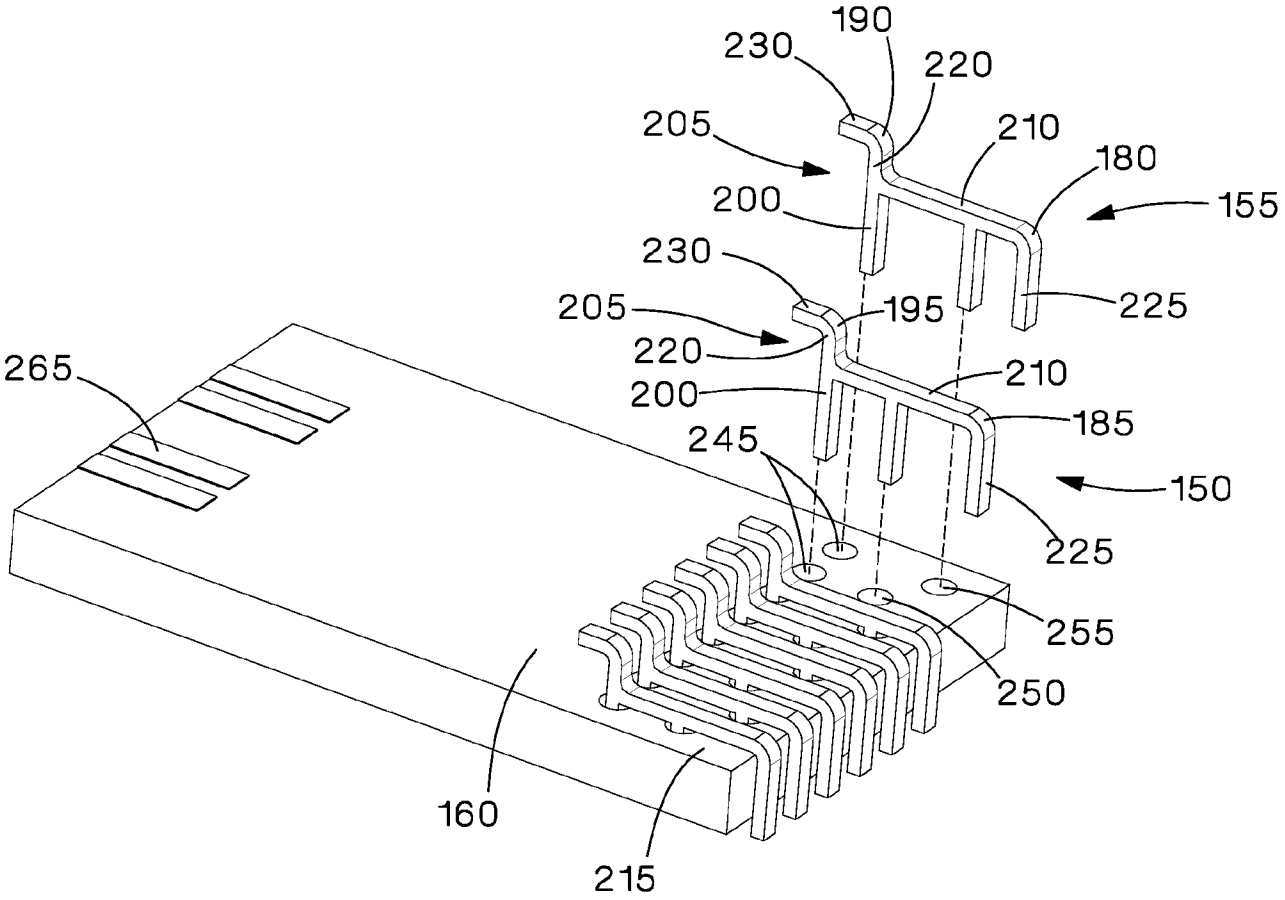
Figure 12:
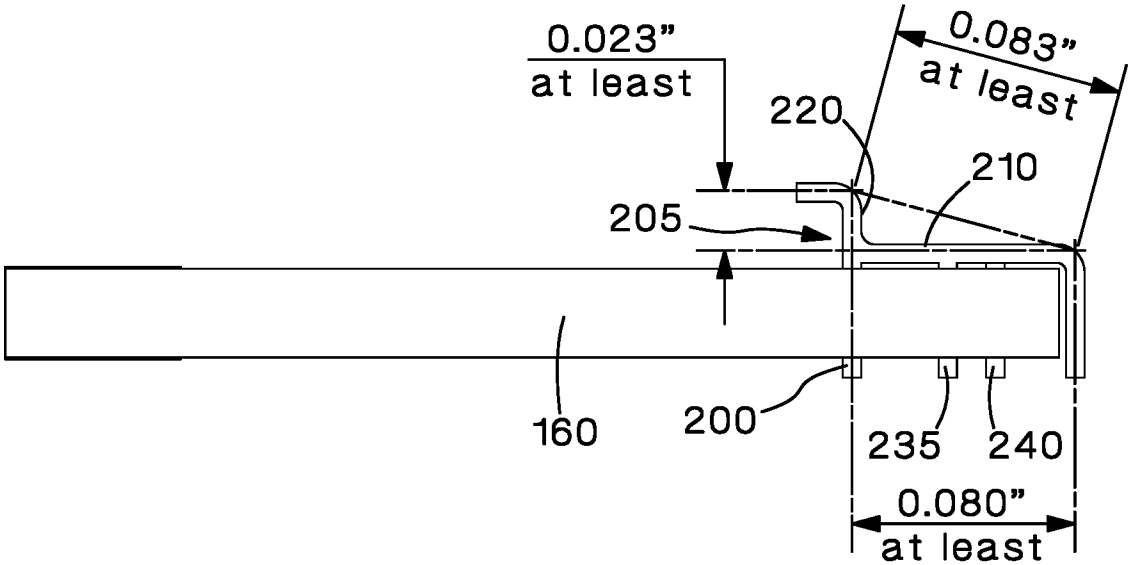
FIG. 12 is a side profile view of the plug contacts and the plug PCB of FIGS. 10-11.

To separate the mated plug/jack combination further, FIGS. 7-12 illustrate an exemplary embodiment of the modified RJ45 plug 115 with FIGS. 7-9 illustrating isometric exploded view of the plug 115 with cable 120, FIGS. 10-11 illustrating the plug's PCB and plug contacts, and FIG. 12 illustrating a side profile view of the plug contacts. Plug 115 includes plug nose 130, conductive right shell 135, conductive left shell 140, PCB assembly 145 (which includes first contacts 150, second contacts 155, plug PCB 160, cable over molding 165, and pair manager 170) and bend radius control boot 175.

First contacts 150 and second contacts 155 are each designed to provide multiple mating surfaces in order to mate with different configurations of an RJ45 plug. In particular, the first mating surfaces 180 and 185 of respective first contacts 150 and second contacts 155 are located such that they fall within the range of the defined preferred electrical mating point for an WC-60603-7:2010 male connector, as provided in the BACKGROUND of this specification. When plug 115 is mated with a conventional RJ45 jack, first mating surfaces 180 and 185 come into contact with the jack's respective PICs and establish a current path between the plug PCB 160 and the jack. However, when mated with the modified RJ45 network jack 110, first mating surfaces 180 and 185 do not make direct mechanical contact with jack's PICs and remain positioned off the main current path. Instead, when mated with the modified RJ45 network jack 110, second mating surfaces 190 and 195 on respective first contacts 150 and second contacts 155 come into contact with the jack's PICs, establishing an alternate, shorter current path between the PICs and the plug PCB 160.

The aforementioned functionality can be achieved by providing specially designed plug contacts 150, 155 as shown in FIGS. 10-12. In particular, each contact includes post 200 that is secured within the plug PCB 160 and serves to connect the contact with circuitry on the plug PCB 160, a contact split 205 positioned at one end of the post 200, a first contact section 210 connected to contact split 205 and extending adjacent to surface 215 of the plug PCB 160, and a second contact section 220 connected to contact split 205 and extending away from surface 215. To separate the plug contact mating surfaces, first mating surfaces 180, 185 are positioned at an end of first contact section 210 and second mating surfaces 190, 195 are positioned at an end of second contact section 220, with both first and second mating surfaces 180-195 being positioned at respective contact section ends that are distal to contact split 205. In the embodiment illustrated in the figures, first mating surfaces 180, 185 are at least 0.083 inches away from second mating surfaces 190, 195, respectively. Additionally, first mating surfaces 180, 185 can be at least 0.08 inches away from contact split 205 and second mating surfaces 190, 195 can be at least 0.023 inches away from contact split 205, with contact split 205 being non-collinear with respect to a line drawn between a first and second mating surface of a respective plug contact.

In this configuration, the current path from the second mating surfaces 190, 195 to the plug PCB 160 can be shorter than the path from the first mating surfaces 180, 185. This reduction in distance may result in more efficient crosstalk compensation. Furthermore, to potentially aid in manufacturing, installation, and performance of the contacts, first and second extensions 225 and 230 can extend from first and second mating surfaces 180,185 and 190,195, respectively. Since it is desirable (and in some cases it may be required) that at least some of the mating surfaces 180-195 have a bend radius, such bend radius may be realized during manufacturing by bending extensions 225 and 230 relative to the first and second contact sections 210 and 220, respectively, at predetermined angles (e.g., 90 degrees). While in one sense they may be viewed as a byproduct of manufacturing, these extensions may also be used to tune amount of capacitive coupling that occurs between adjacent plug contacts. Additionally, secondary posts 235 and 240 may be provided on respective plug contacts. Posts 235, 240 may be used to further secure respective plug contacts 150 and 155 within the PCB, and in some embodiments provide a current path between the plug contacts and any circuitry that may be present on the plug PCB 160.

To assemble the plug 115, first contacts 150 and second contacts 155 are electrically secured to plug PCB 160, as shown, through a soldered connection of solder posts 200, 235, and 240 into respective vias 245, 250, and 255. Note that other non-limiting means of connecting first contacts 150 and second contacts 155 to rigid PCB 160 (e.g., compliant/press fit pins) may be used. Additionally, conductors 260 of cable 120 are attached to PCB 160 through pads 265. While conductors 260 are shown attached to PCB 160 through a soldered connection, other non-limiting means of connecting conductors to a PCB may be used. To encase the PCB 160, plug latch arms 270 of plug nose 130 align with respective pockets 275 and 280 of conductive right shell 135 and conductive left shell 140. Staking posts 285 of conductive right shell 135 align with staking pockets 290 of conductive left shell 140 and staking posts 295 of conductive left shell 140 align with staking pockets 300 of conductive right shell 135. Staking posts 285 and 295 are staked in respective staking pockets 290 and 300 to secure both shells together. As the shells are joined together, grounding ribs 305 and 310 of respective conductive right shell 135 and conductive left shell 140 compress braid 315 and make an electrical ground connection between cable 120 and shielded RJ45 plug assembly 115. To complete the assembly, bend radius control boot 175 is secured to the plug 115 by having boot latches 320 and 325 of respective conductive right shell 135 and conductive left shell 140 latch on to boot pockets 330.

Figure 13:
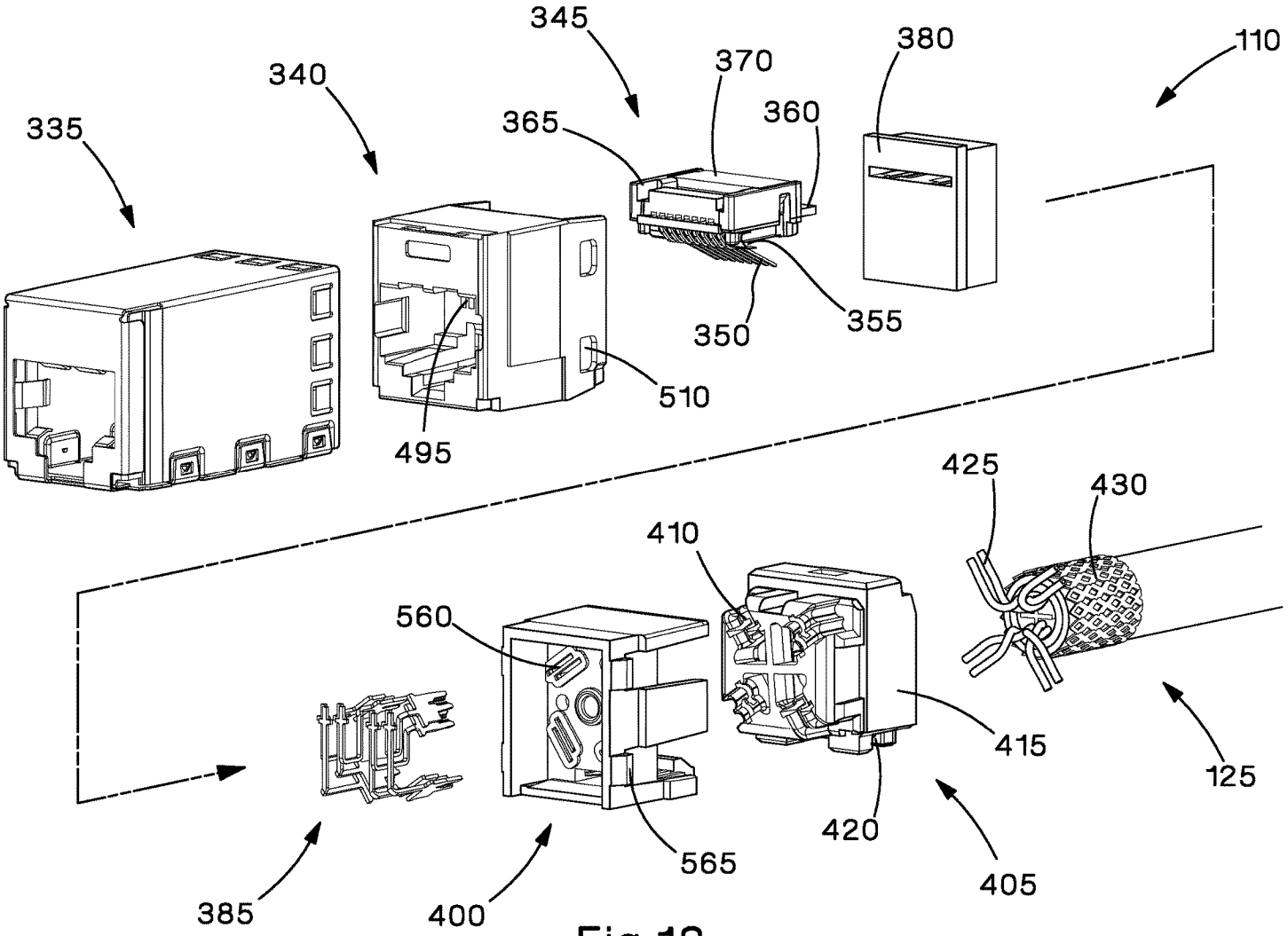
FIGS. 13-15 are isometric exploded views of a modified RJ45 jack according to an embodiment of the present invention.
Figure 14:
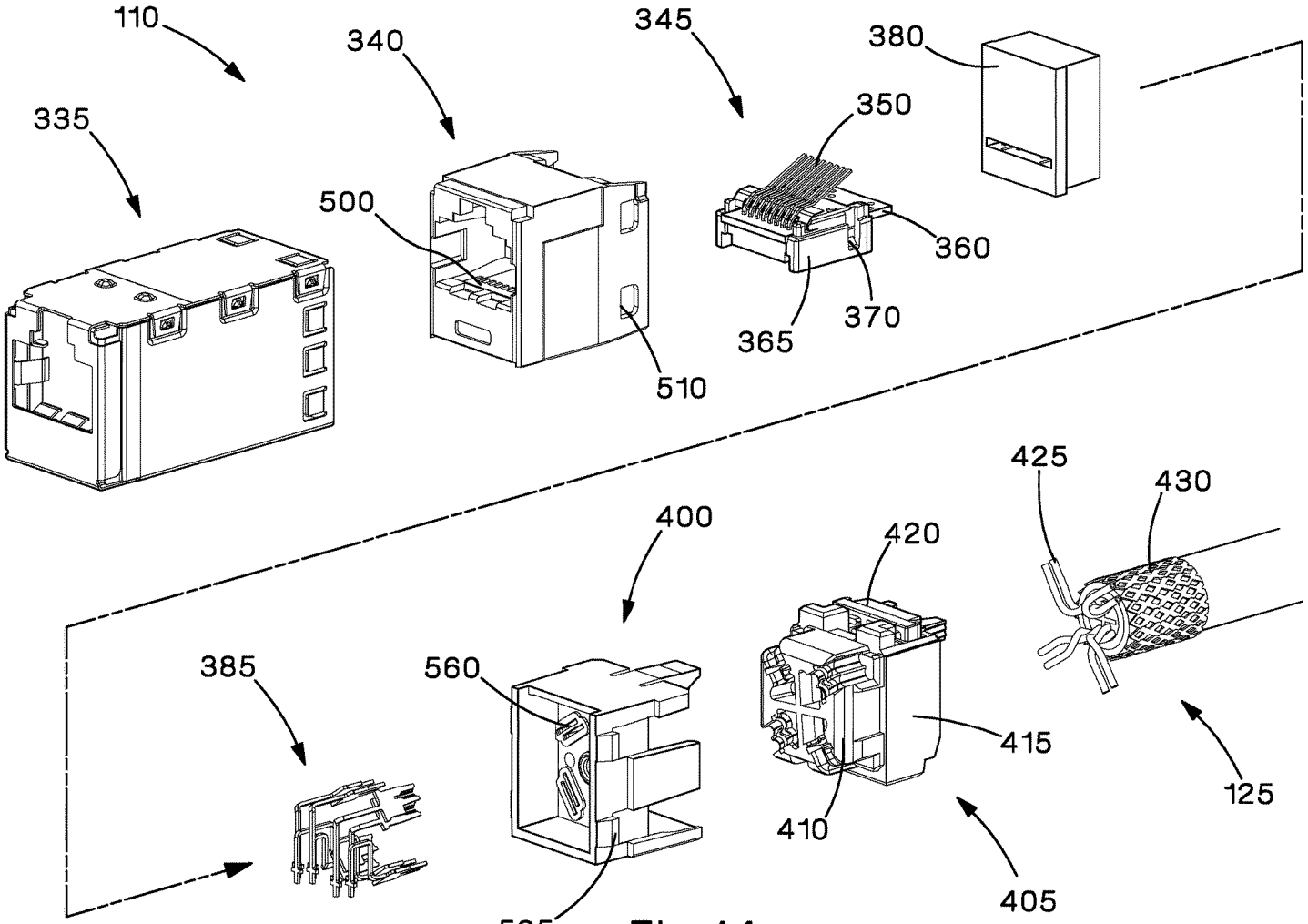
Figure 15:
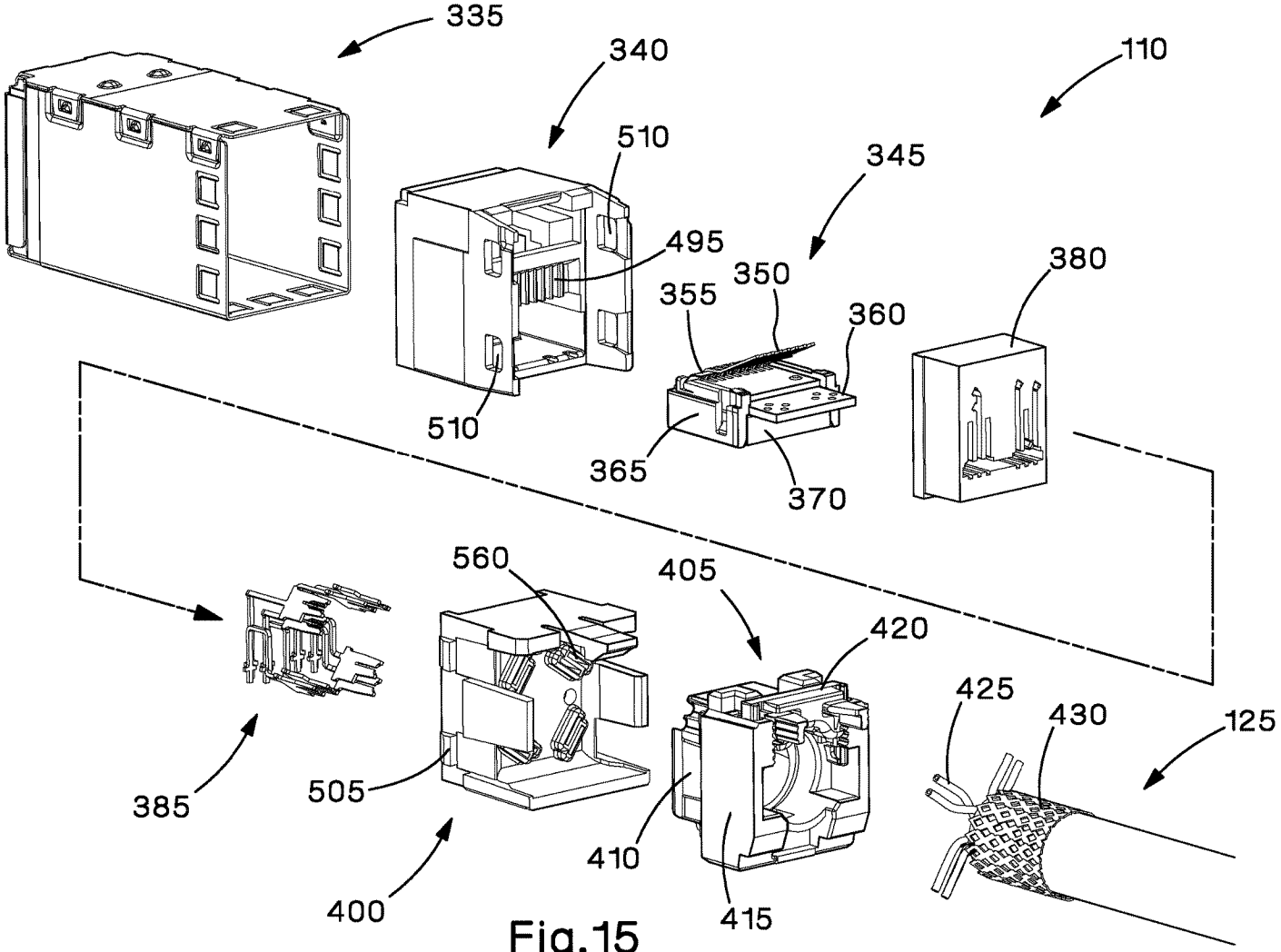
Figure 16:
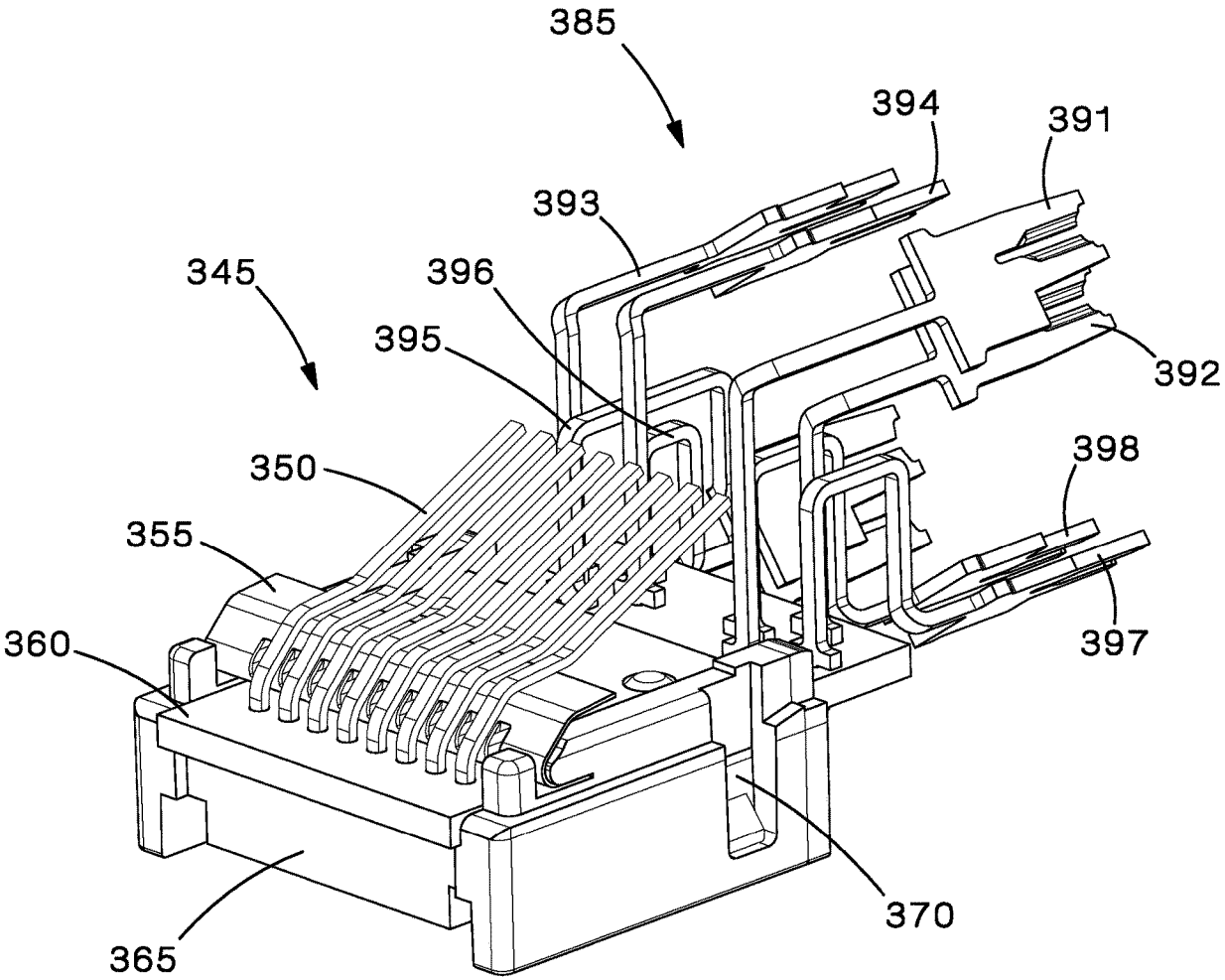
FIGS. 16-17 are isometric views of an embodiment of a sled assembly and insulation displacement contacts (IDCs) used in the modified RJ45 jack.
Figure 17:
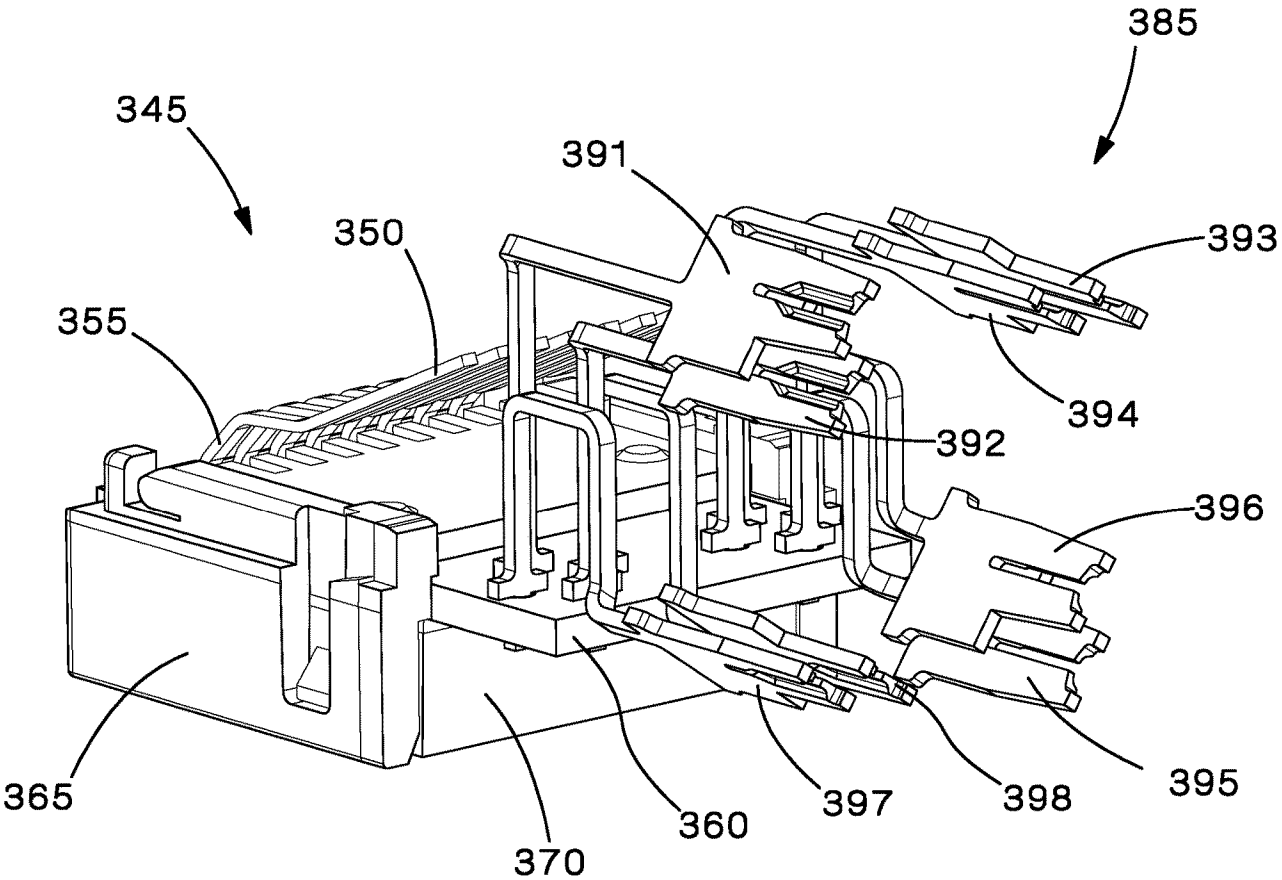
Figure 18:
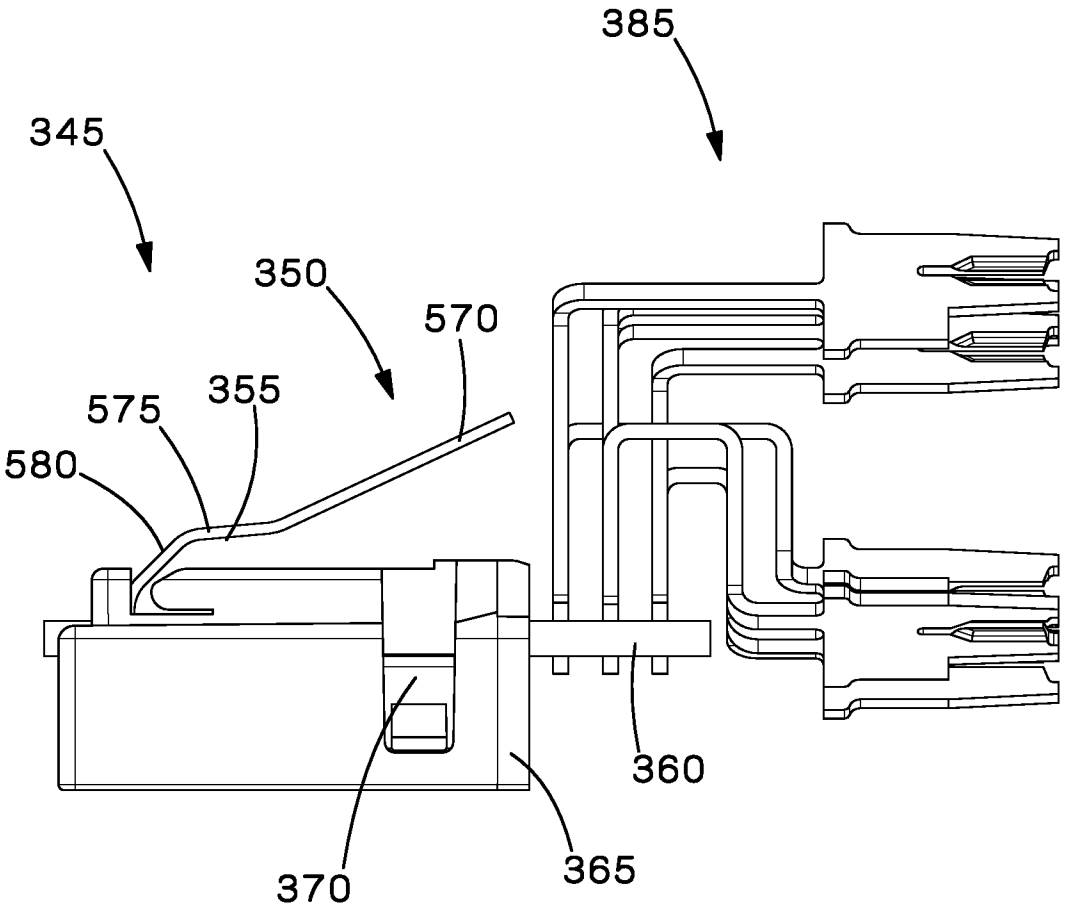
FIG. 18 is a side profile view of the sled assembly and IDCs of FIGS. 16-17.
Figure 19:
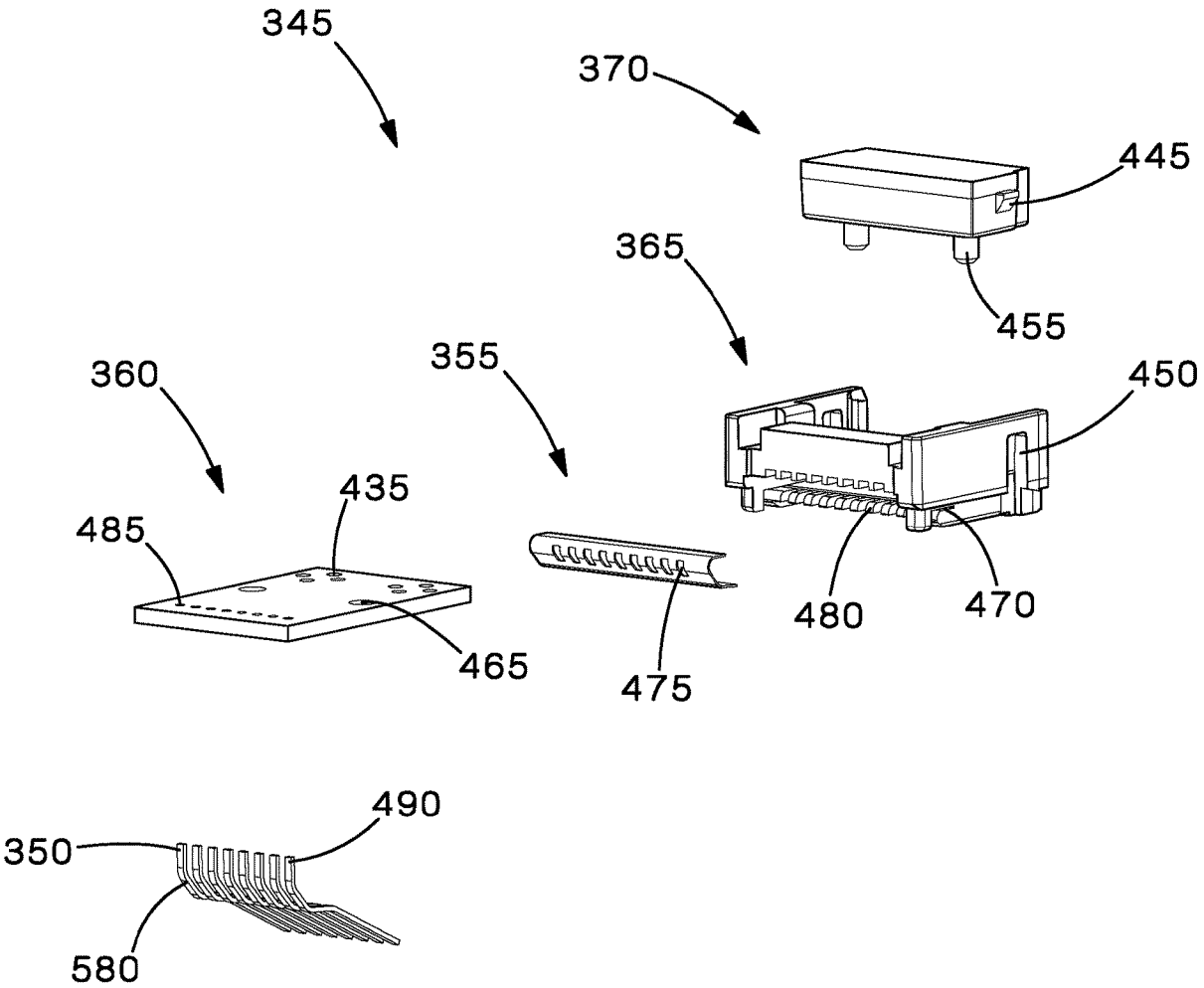
FIGS. 19-21 are isometric exploded views of a sled assembly of FIGS. 16-17.
Figure 20:
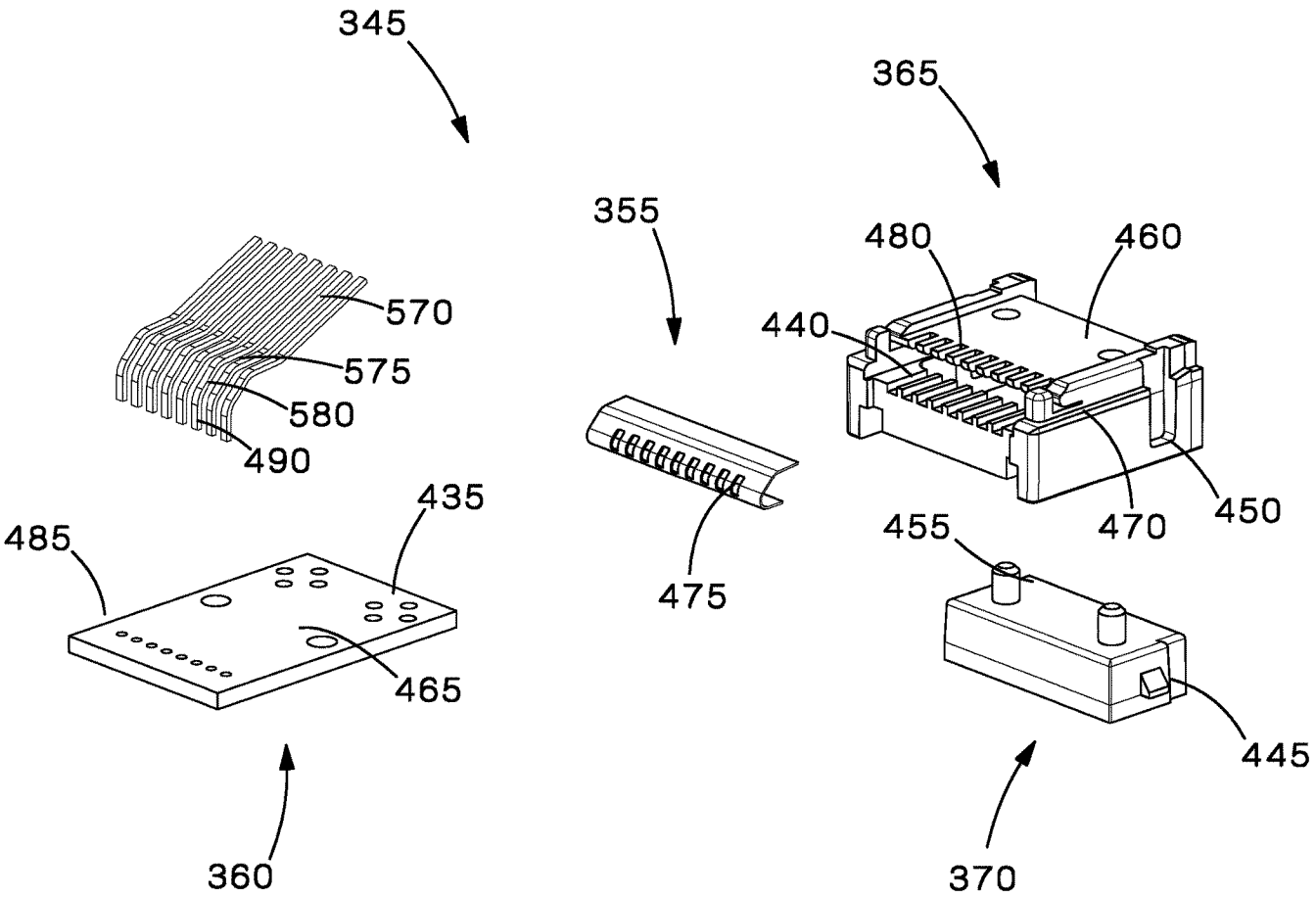
Figure 21:
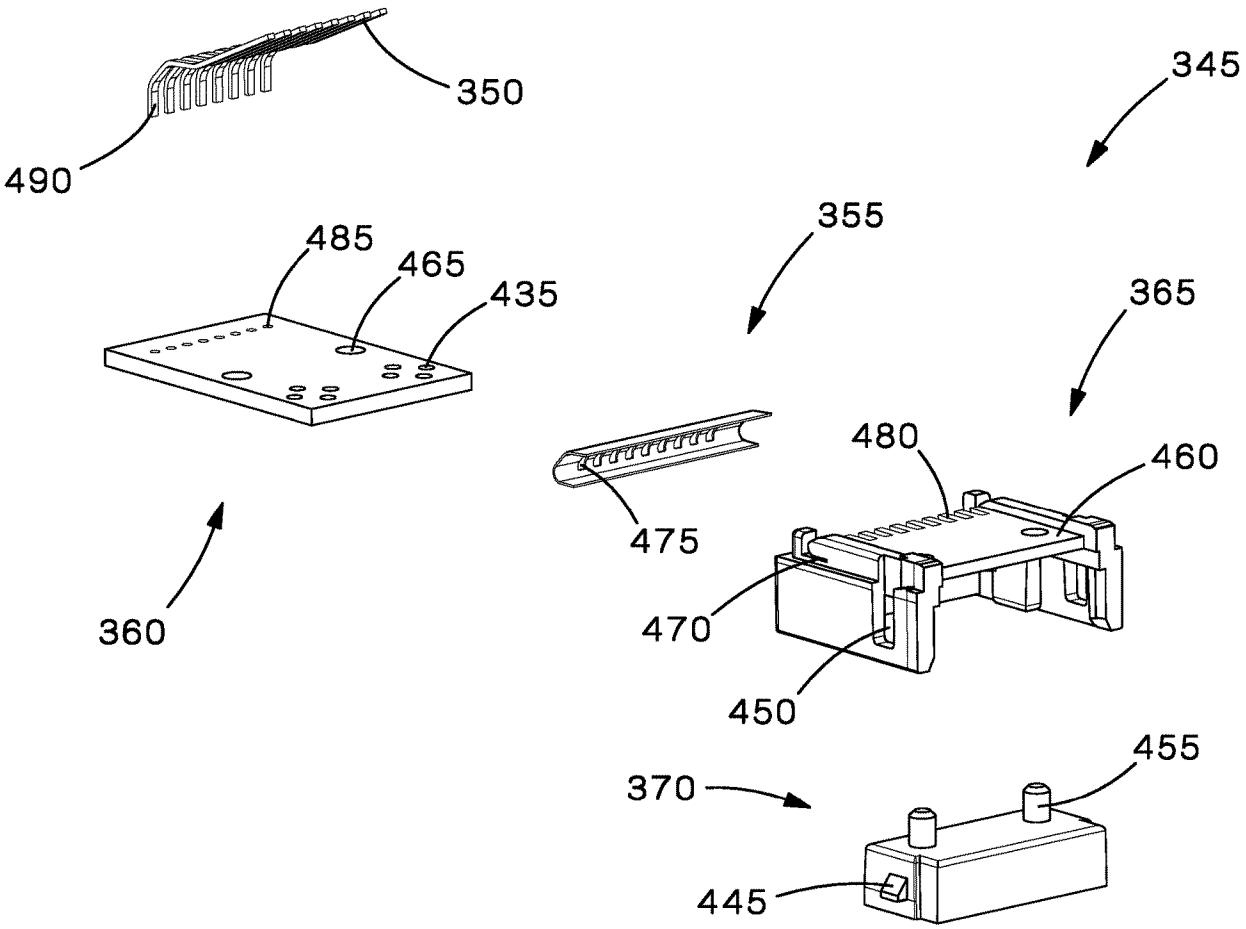
Figure 22:
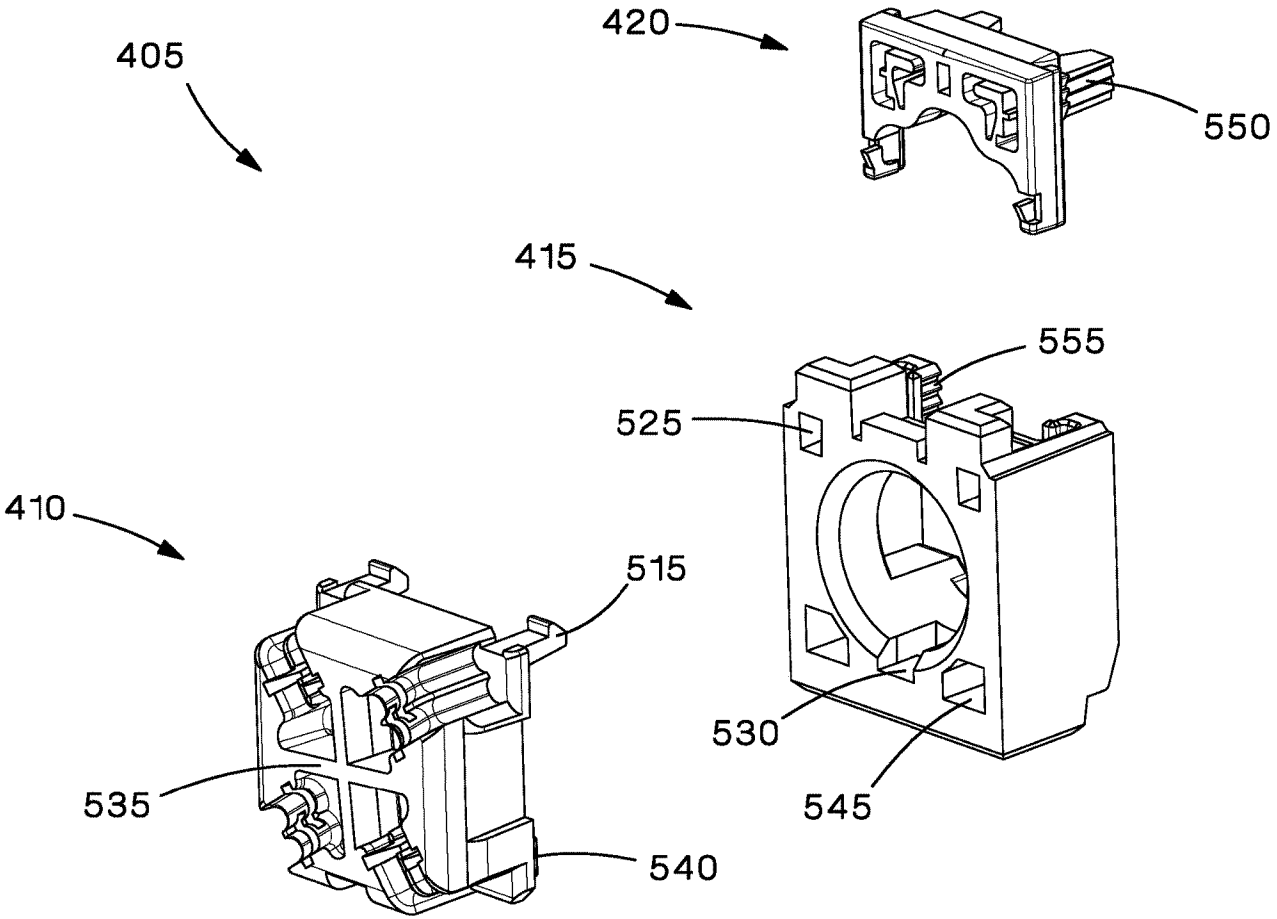
FIGS. 22-23 are isometric exploded views of an embodiment of a wire cap assembly used in the modified RJ45 jack.
Figure 23:
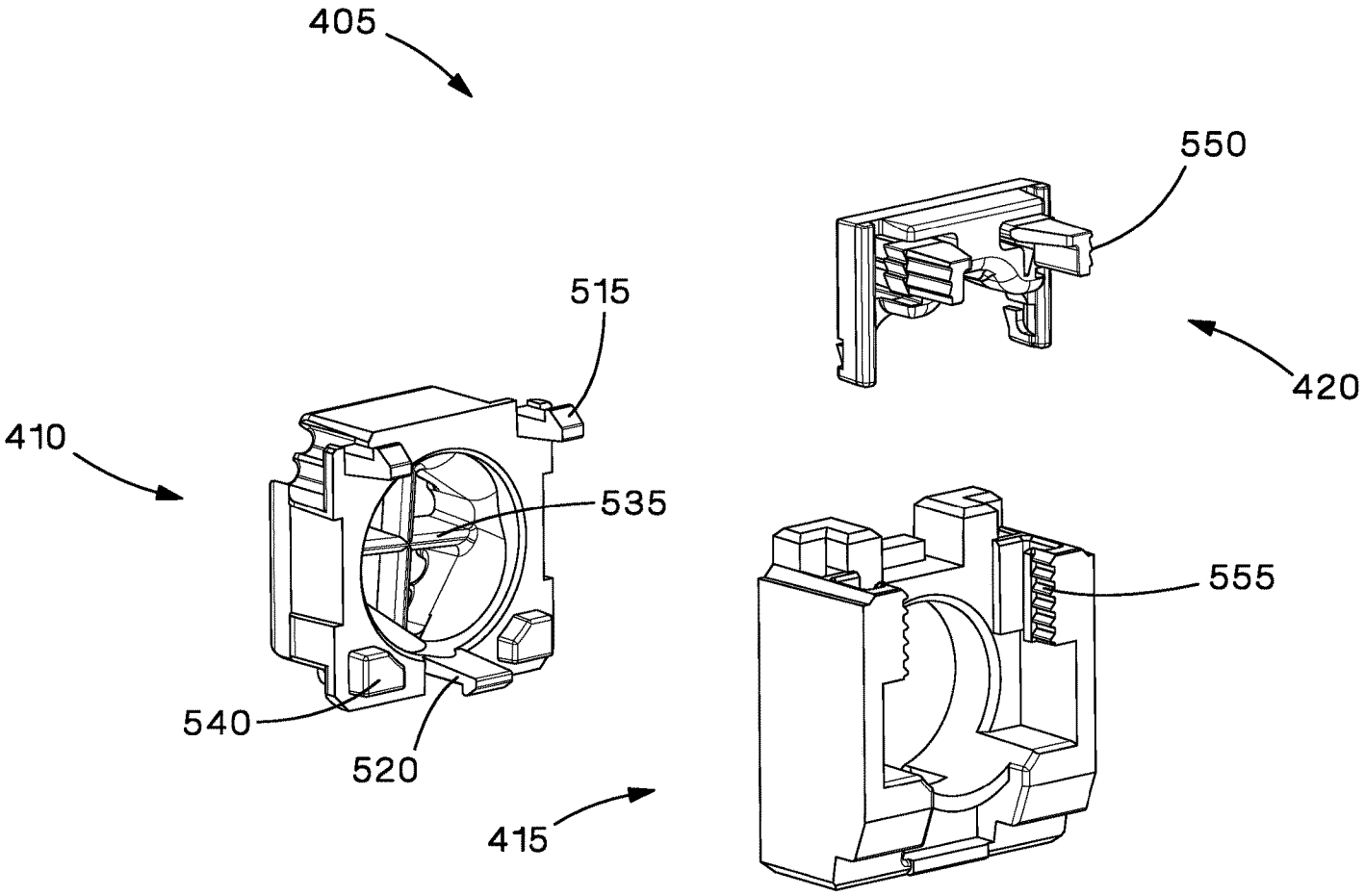

When assembled, plug 115 can be mated with a conventional RJ45 jack or with any number of specially modified RJ45 jacks that will engage the second mating surfaces 190, 195. One example of a modified RJ45 jack 110 is shown in FIGS. 13-27. As shown in the exploded views of the jack 110 in FIGS. 13-15, the jack includes conductive shell 335, jack housing 340, sled assembly 345 (which includes PICs 350, flexible PCB 355, rigid PCB 360, top sled holder 365, and bottom sled holder 370), IDC support 380, IDC assembly 385 (which includes IDCs 391, 392, 393, 394, 395, 396, 397, and 398), rear sled 400, wire cap assembly 405 (which includes wire cap conductor holder 410, conductive wire cap back 415, and conductive strain relief clip 420). Jack 110 can be terminated to cable 125 which includes conductors 425 and braid 430. A more-detailed view of the sled assembly 345 together with the IDC assembly 385 is shown in FIGS. 16-18, with additional details regarding the sled assembly 385 being shown in FIGS. 19-21 which show exploded views thereof.

To assemble the RJ45 jack 110, IDC assembly 385 is electrically secured to rigid PCB 360 through a soldered connection through vias 435. Note that the soldered connection is merely exemplary and other non-limiting means of connecting IDC assembly 385 to rigid PCB 360 (e.g., compliant/press fit pins) may be used. Then IDC support 380 is positioned over IDC assembly 385 so that during termination of conductors 425 of cable 125, IDCs 391-398 stay in position and are supported by the base. Then rigid PCB 360 is positioned onto top sled holder 365 and sits on PCB rails 440. Thereafter, bottom sled holder 370 is attached to top sled holder 365 through the engagement of bottom holder snaps 445 and top holder pockets 450. Posts 455 of bottom sled holder 365 align with both holder holes 460 and PCB holes 465. At the same time, flexible PCB 355 is positioned into flex pocket 470 of top sled holder 365 with slots 475 providing clearance for plug combs. Mandrel 480 makes contact with flexible PCB 355 between flexible PCB slots 475 and acts as a pinch point for an electrical connection between PICs 350 and flexible PCB 355. After the assembly of flexible PCB 355, PICs 350 are electrically secured to rigid PCB 360. As shown, PICs 350 are soldered through vias 485 by way of solder surface 490. However other non-limiting means of connecting PICs 350 to rigid PCB 360 may be used such as compliant/press fit pins. Thereafter, sled assembly 345, IDC assembly 385, and IDC support 380 are placed into jack housing 340, and PICs 355 are combed by housing back combs 495 and front combs 500 which align with plug combs. To trap the sled assembly 345, IDC assembly 385, and IDC support 380 in jack housing 340, rear sled 400 is secured to jack housing 340 through rear sled snaps 505 which align with housing pockets 510.

Figure 24:
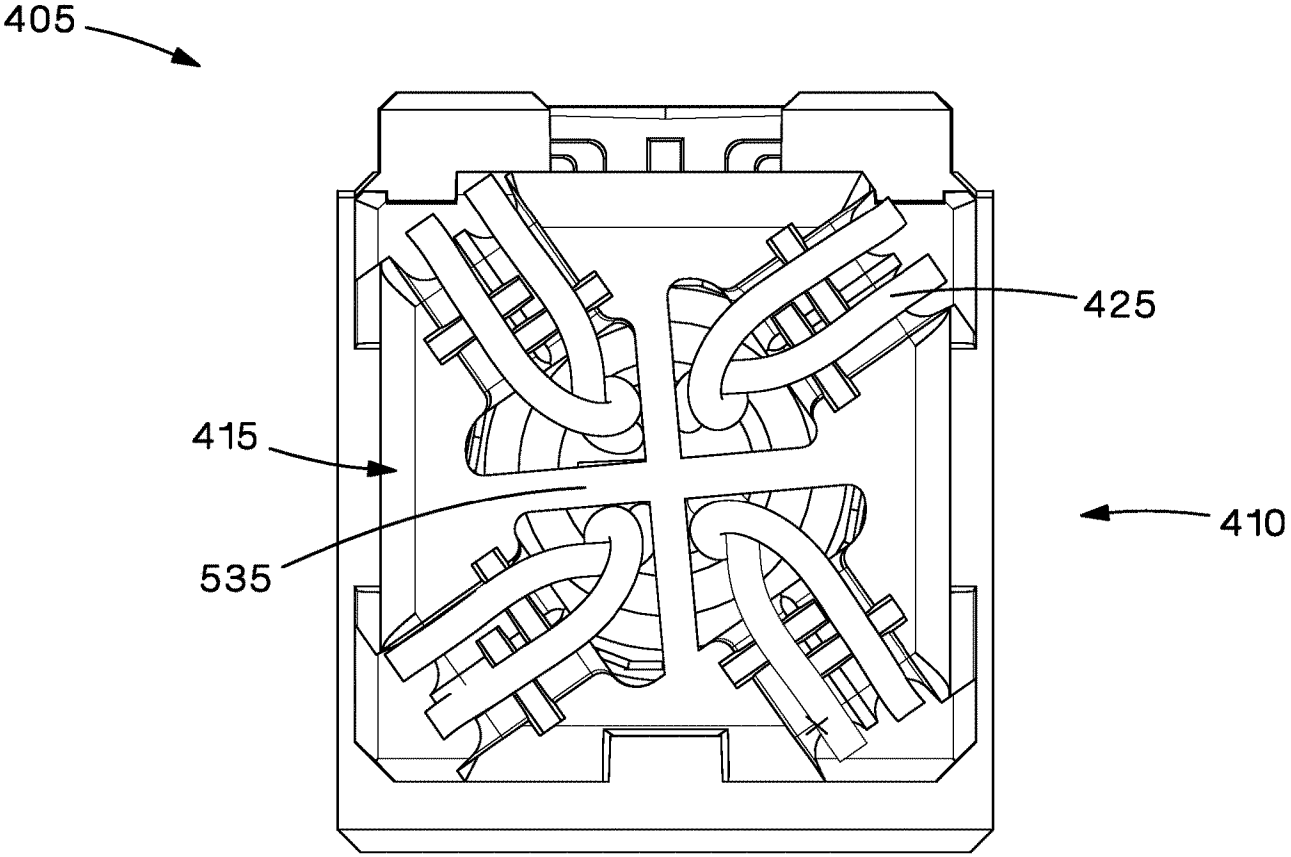
FIG. 24 is a front view of the wire cap assembly of FIGS. 22-23.
Figure 25:
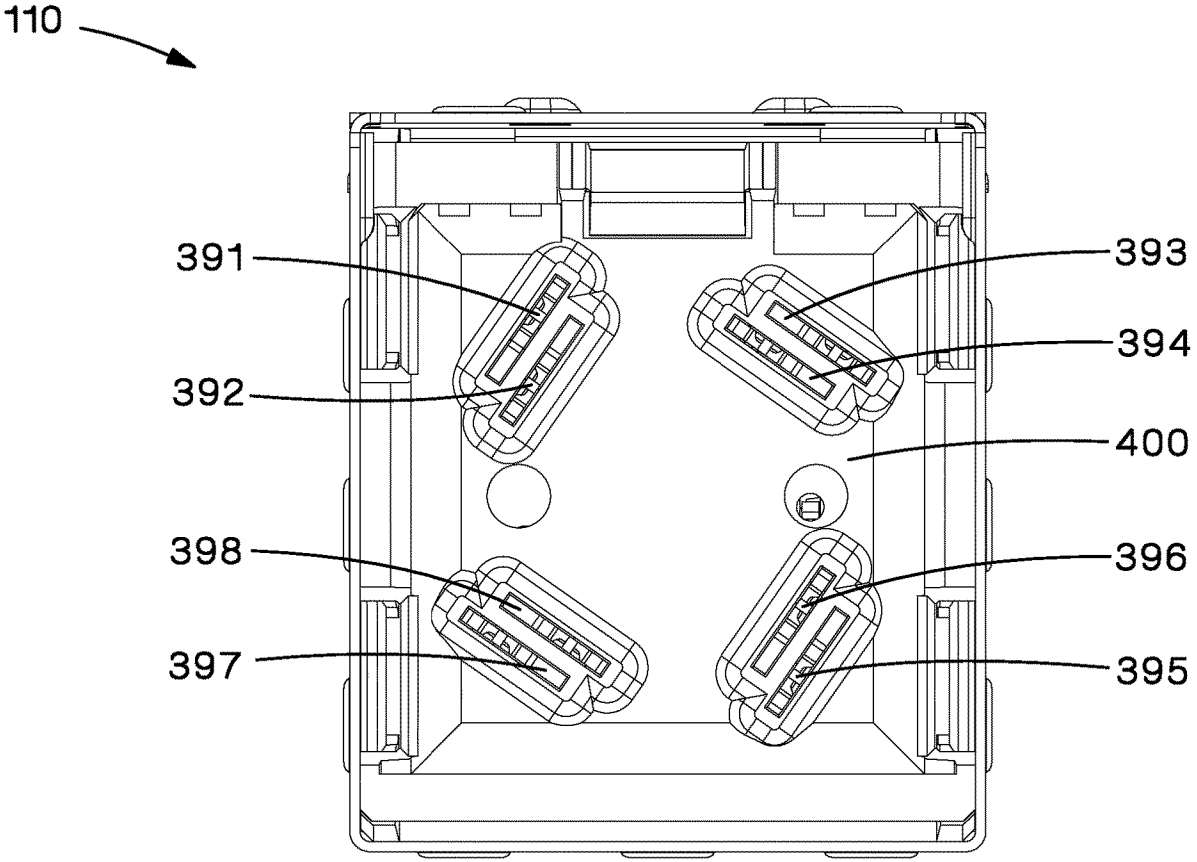
FIG. 25 is a rear view of an embodiment of a rear sled used in the modified RJ45 jack.
Figure 26:
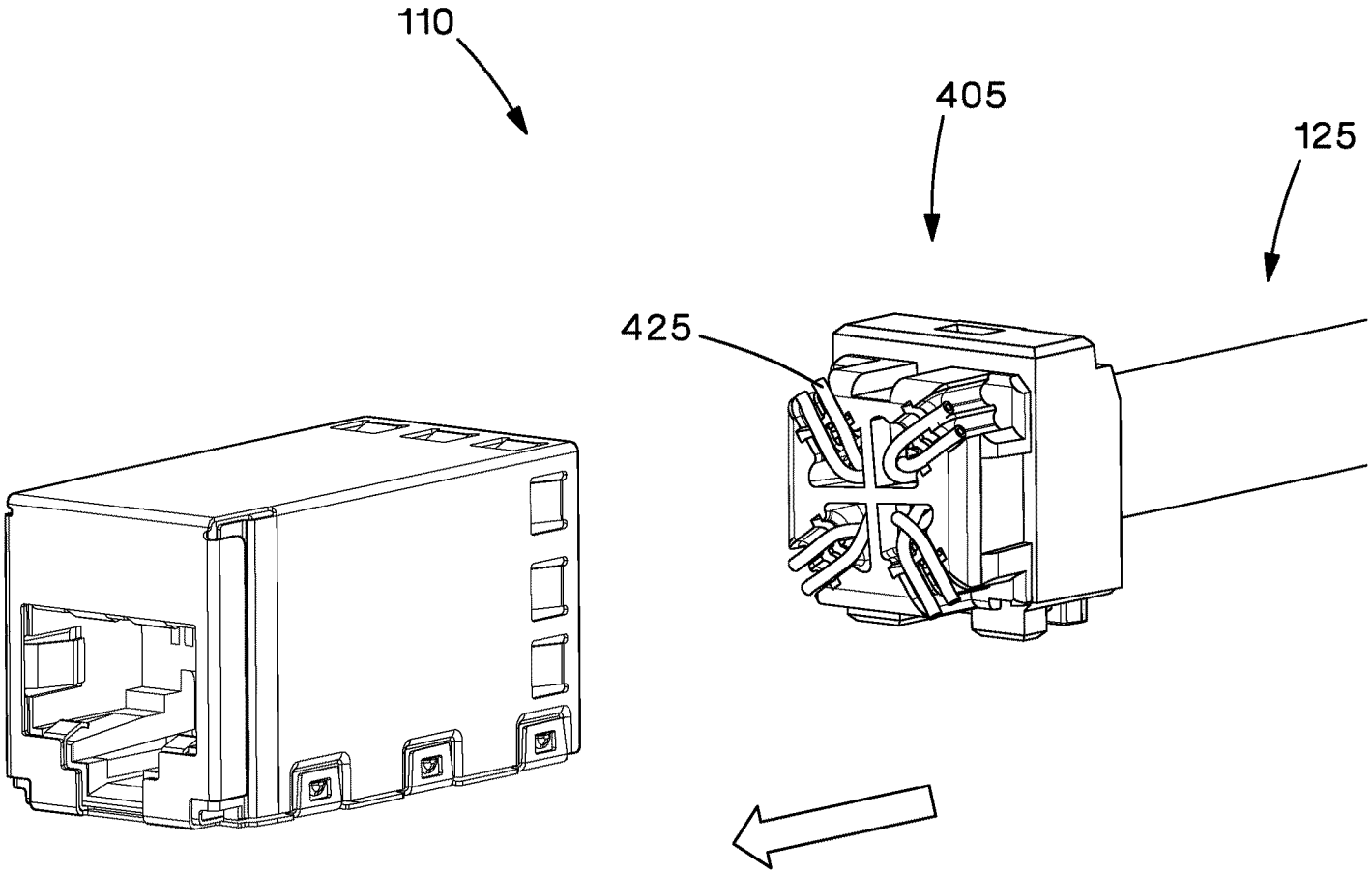
FIGS. 26-27 are isometric views of how the wire cap assembly of FIGS. 22-23 is joined with the rear of the modified RJ45 jack.
Figure 27:
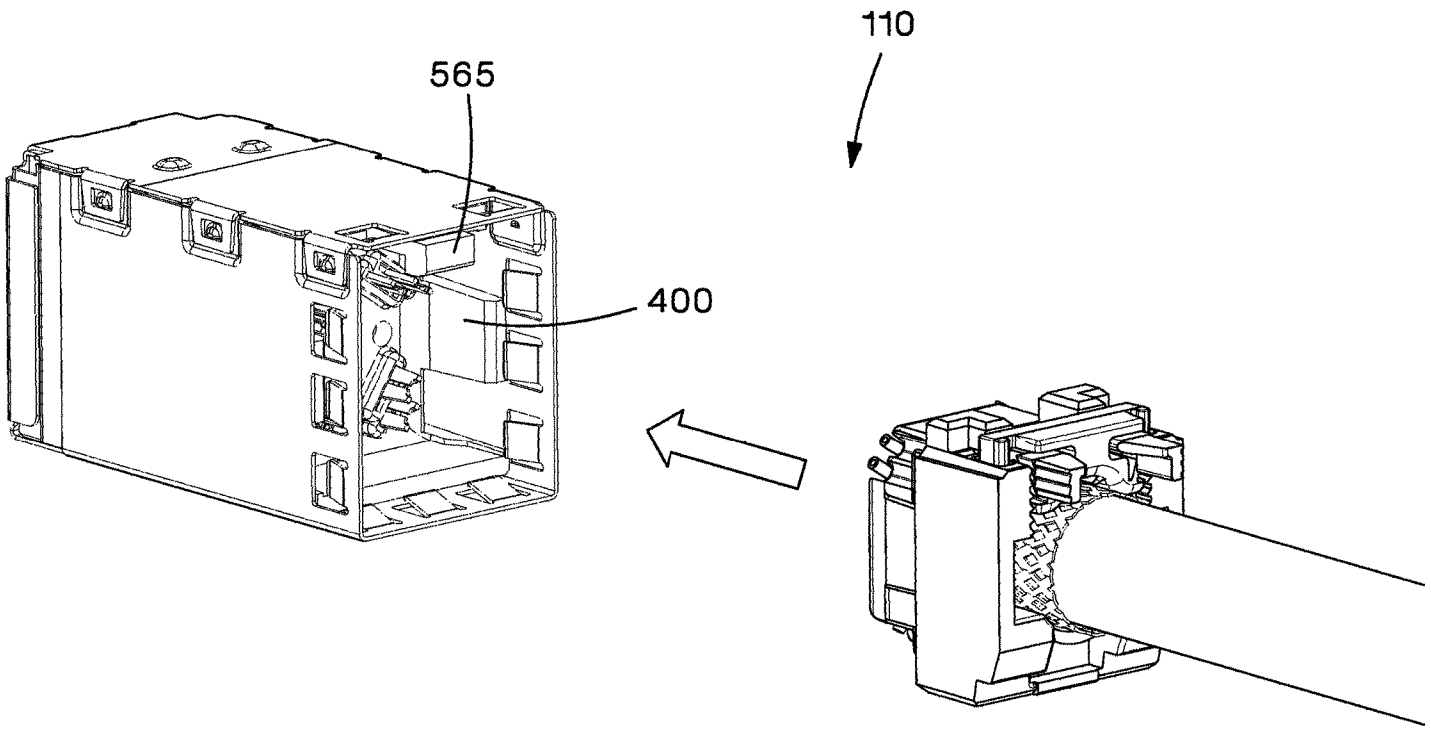

Once assembled, the jack 110 can be used to terminate a communication cable 125. The components involved in this process are illustrated in detail in FIGS. 22-27. To start, referring particularly to FIGS. 22 and 23, cable 125 is strung through the wire cap back 415 and the wire cap holder 410. Wire cap conductor holder 410 is secured to conductive wire cap back 415 through latches 515 and 520 which align with latch pockets 525 and 530, respectively. Pair separator 535 of wire cap conductor holder 410 isolates conductor 425 pairs into quadrants during final assembly. Pair separator 535 may be removed to allow for more room for cable assembly, and in cable constructions such as S/FTP where each pair is individually foiled and pair separator 535 may not be electrically beneficial as the pairs are already electrically separated. Posts 540 of wire cap conductor holder 410 align with slots 545 of conductive wire cap back 415 for added assembly constraint and improved alignment of the two parts. In their default state, flexible arms 550 of conductive strain relief clip 420 engage with teeth 555 of conductive wire cap back 415. To disengage, the flexible arms 550 are compressed inward towards each other. As the wire cap 400 is assembled, FIG. 24 illustrates how conductors 425 are positioned in preparation for joining with the remainder of the jack 110. On the rear sled 400, as shown in FIG. 25, IDC slots 560 align with corresponding IDCs of IDC assembly 385. To complete the assembly, as shown in FIGS. 26 and 27, wire cap assembly 405 is joined with and is secured to rear sled 400 through the engagement of flexible latch 565 with a corresponding latching feature. The mating of the wire cap assembly 405 and the rear sled 400 causes the IDCs to make contact with the conductors 425 of the cable 125 and thereby establish a communication through the jack 110.

Referring back to FIGS. 18 and 20, PICs 350 of the modified jack 110 have three distinct surfaces including first mating surface 570, transition surface 575, and second mating surface 580. Transition surface 575 is optional and can be removed in non-limiting ways such as adjoining the transition between first mating surface 570 and second mating surface 580. In the currently described embodiment, first and second mating surfaces 570 and 580 are designed to be substantially non-collinear. It should be noted that mating surfaces can be either flat or curved. Thus, to determine collinearity in case of a flat mating surface, a surface line collinear with that flat surface is considered. On the other hand, in the event of a curved mating surface, a surface line that is tangential to the contact point is used. Accordingly, the mating surfaces can be said to be substantially non-collinear when the surface lines of each of the mating surfaces are substantially non-collinear, as is the case with the currently described embodiment. (Note that the same derivation of non-collinearity may also be applied to a modified RJ45 plug).

As a result, first mating surface 570 is positioned on PICs 350 such that it makes contacts with an IEC-60603-7:2010 male connector within the range of the defined preferred electrical mating point for an IEC-60603-7:2010 connector. Second mating surface 580, when paired with a standard IEC-60603-7:2010 male connector, makes no direct contact with the plug contacts and acts as part of the transmission path towards rigid PCB 360. Second mating surface 580 of PICs 350, when mated with the modified RJ45 plug assembly 115, makes an electrical contact with the plug's contacts closer to rigid PCB 360 than if contact were made at first mating surface 570. When the mating point is on first mating surface 580, the second mating surface 570 and transition surface 575 are off of the main electrical path.

Figure 28:
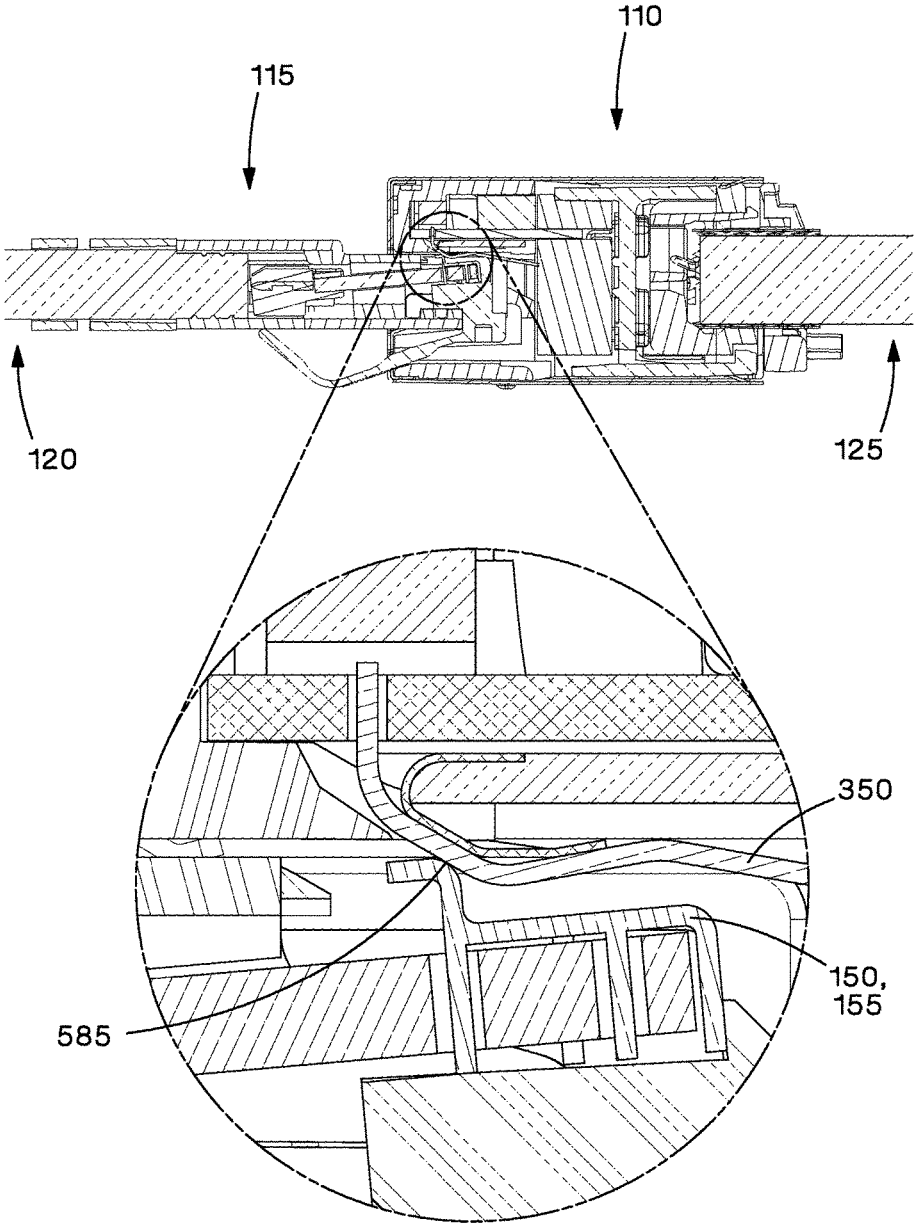
FIG. 28 is a cross-section view taken along section line 28-28 of FIG. 3 across the center of the mated assembly of modified RJ45 network jack and modified RJ45 plug.

FIG. 28 is a cross-section view taken along section line 28-28 of FIG. 3 across the center of the mated assembly of modified RJ45 network jack 110 and modified RJ45 plug assembly 115 with respective cables 125 and 120. Contact point 585 is the electrical interface between PICs 350 and first and second contacts 150 and 155 (with a second contact 155 being shown at the forefront of the sectioned view in FIG. 28). Contact point 585 is positioned such that it is outside or at the edge of plug combs 118 (see FIG. 9). Because contact point 585 is positioned outside or at the edge of plug combs 118, the minimum distance from the crosstalk in the plug 115 to the crosstalk compensation in the jack 110 is notably reduced or substantially eliminated. This may assist in being able to better tune for near end crosstalk (NEXT) and/or far end crosstalk (FEXT) performance and allow the plug/jack combination to meet and/or exceed Cat 6, Cat 6A, and proposed Cat 8 standards. Another potential benefit of the mated configuration is that at the location of the second contacts surface the modified RJ45 plug does not have to comply with the crosstalk magnitude requirement of ANSI/TIA-568-C.2, and can be a much higher performing (lower crosstalk) RJ45 plug at the contact location. This may enable superior NEXT and FEXT cancellation ability.

Figure 29:
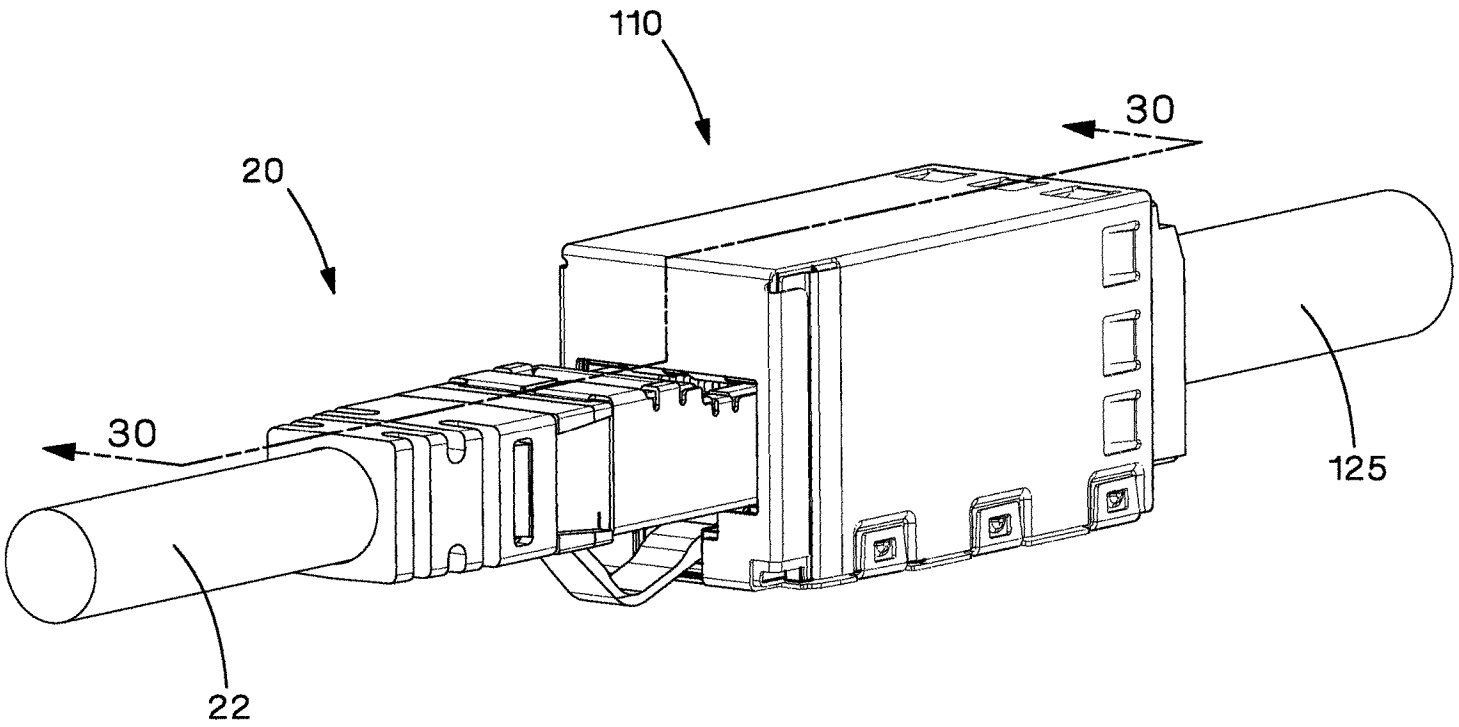
FIG. 29 is an isometric view of a modified RJ45 network jack mated with a conventional RJ45 network plug according to an embodiment of the present invention.
Figure 30:
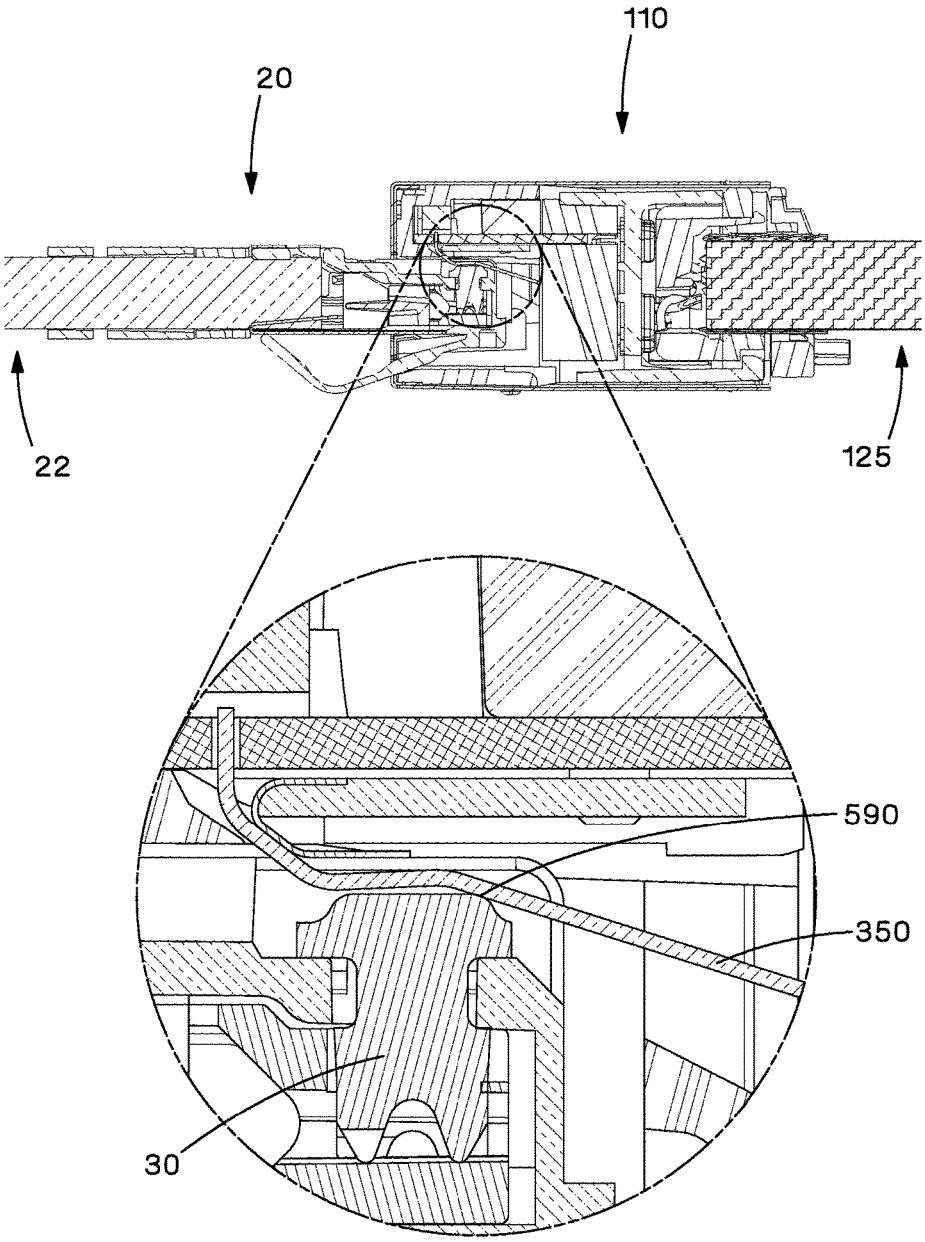
FIG. 30 is a cross-section view taken along section line 30-30 of FIG. 29 across the center of the mated assembly of modified RJ45 network jack and conventional RJ45 plug.

While the modified jack 110 may exhibit high levels of performance which may satisfy future standards when mated with the modified RJ45 plug 115, it is also backwards compatible with conventional RJ45 plugs 20, as shown in FIG. 29 which is a front isometric view of the modified RJ45 network jack 110 mated with a conventional RJ45 plug assembly 20 together with respective cables 125 and 22. A cross-section view of this mated plug/jack combination taken along section line 30-30 of FIG. 29 can be seen in FIG. 30. As shown therein, contact point 590 is the electrical interface between PICs 350 and plug contacts 30. Contact point 590 is in the same relative position as contact point 55

Figure 1:
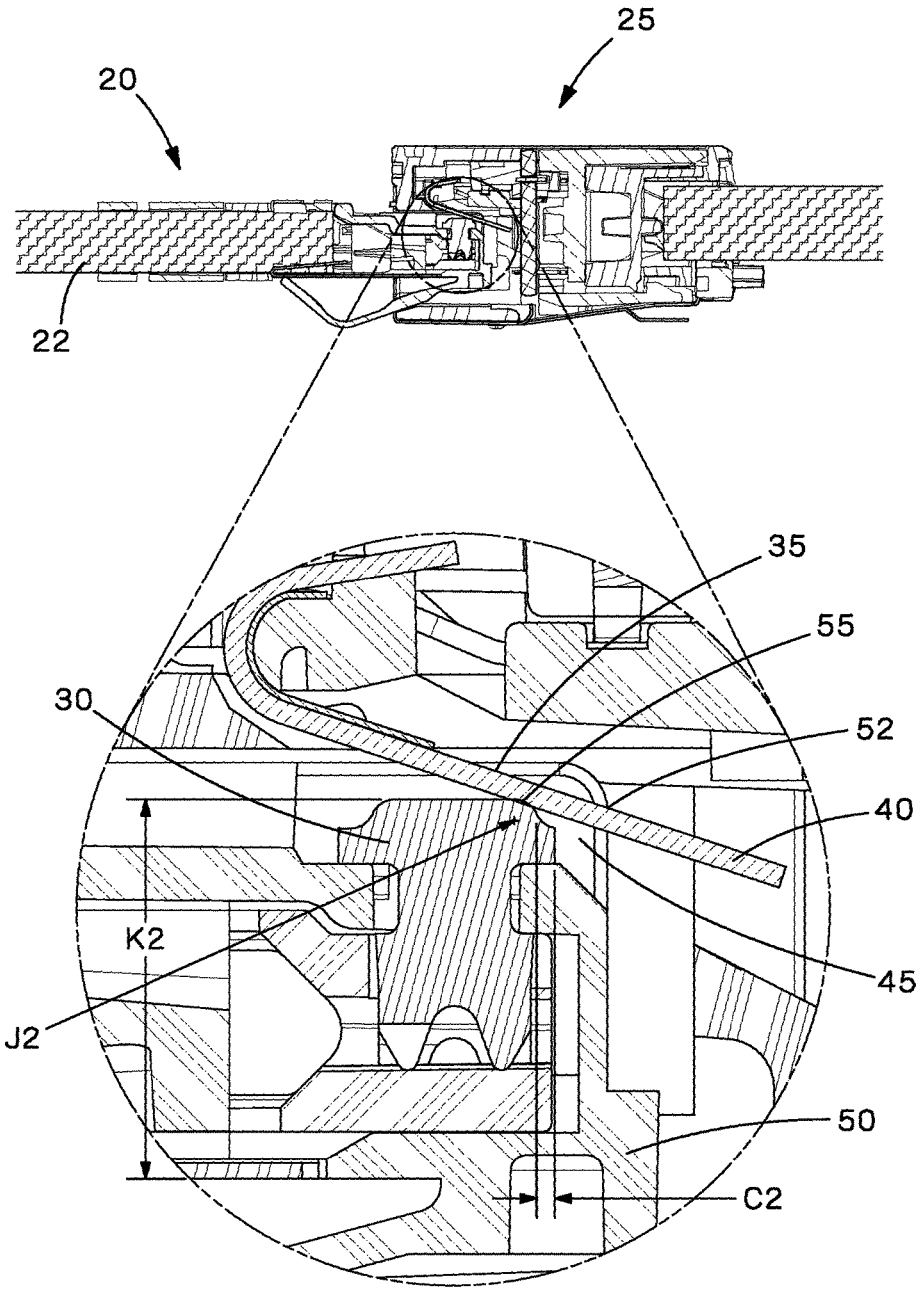
FIG. 1 is a cross-section view of a mated assembly of a conventional RJ45 network jack and a conventional RJ45 network plug.

(FIG. 1) and is approximately in the IEC-60603-7:2010 preferred electrical mating point location.

Figure 31:
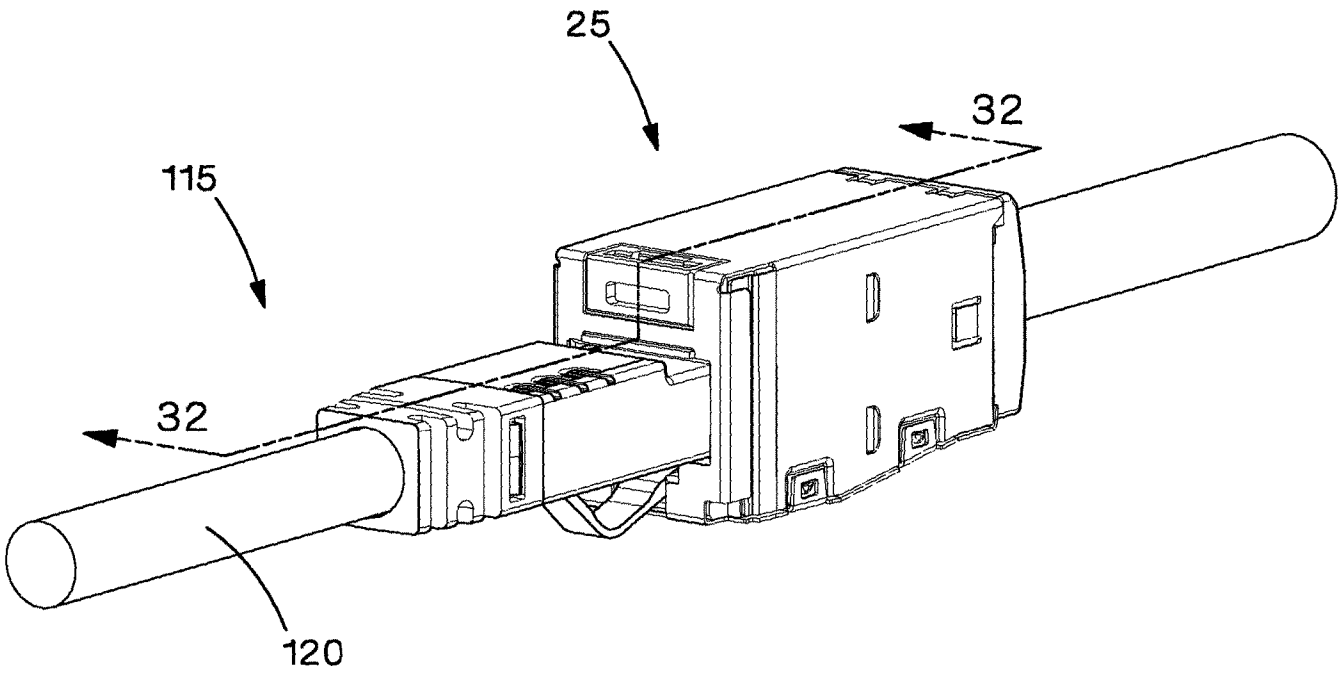
FIG. 31 is an isometric view of a conventional RJ45 network jack mated with a modified RJ45 network plug according to an embodiment of the present invention.
Figure 32:
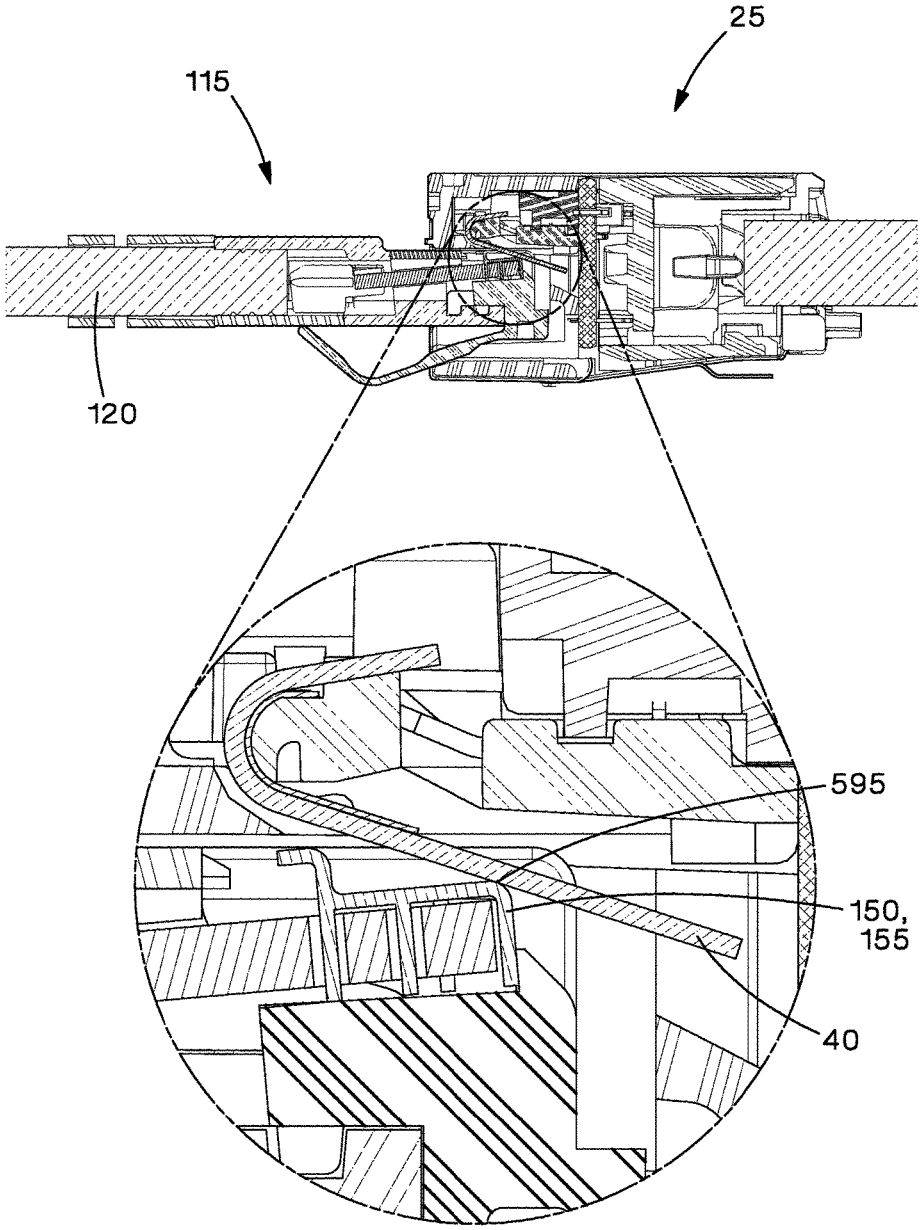
FIG. 32 is a cross-section view taken along section line 32-32 of FIG. 31 across the center of the mated assembly of conventional RJ45 network jack and modified RJ45 plug.

As with the jack 110, modified plug 115 is also designed to be backwards compatible with conventional RJ45 jacks. FIG. 31 illustrates an exemplary front isometric view of the modified plug 115 mated with a conventional RJ45 jack 25 and FIG. 32 a cross-section view taken along section line 32-32 of FIG. 31. As can be seen in FIG. 31, contact point 595 is the electrical interface between PICs 40 and first and second contacts 150 and 155 (with a first contact 150 being shown at the forefront and sectioned in FIG. 32). Contact point 595 is in the same relative position as contact point 55 (FIG. 1) and is approximately in the IEC-60603-7:2010 preferred electrical mating point location.

Figure 33:
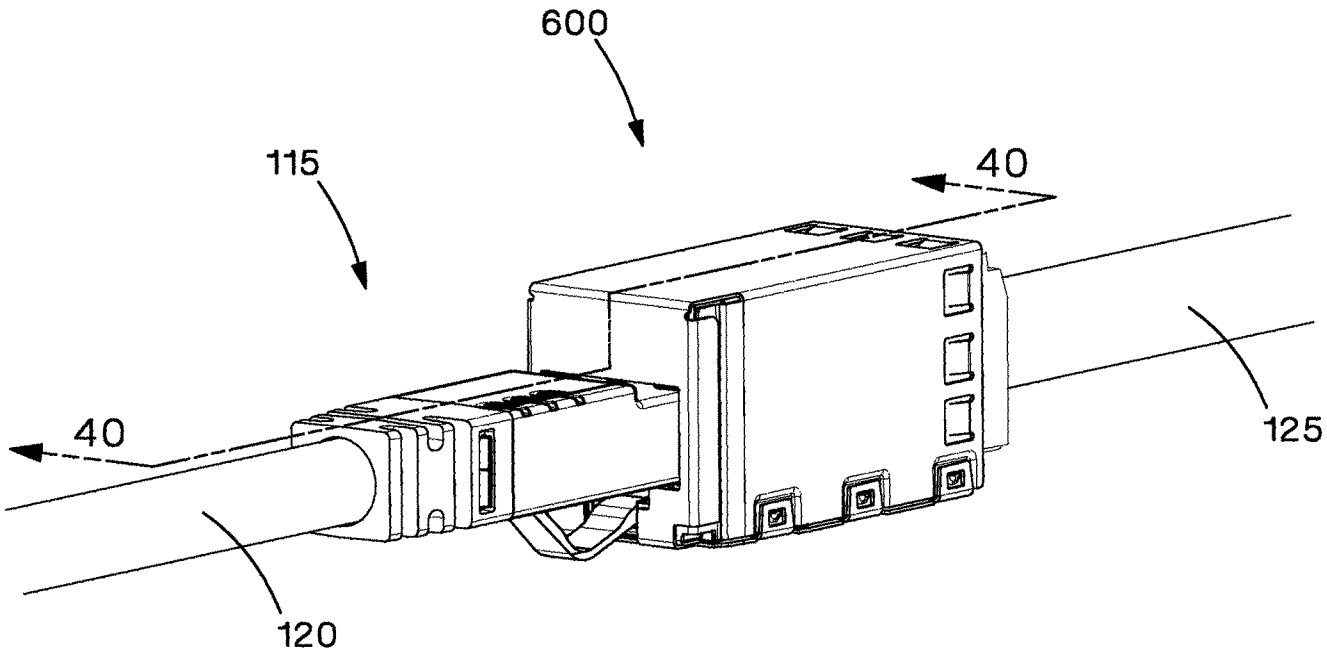
FIG. 33 is an isometric view of a modified RJ45 network jack mated with a modified RJ45 network plug according to an embodiment of the present invention.
Figure 34:
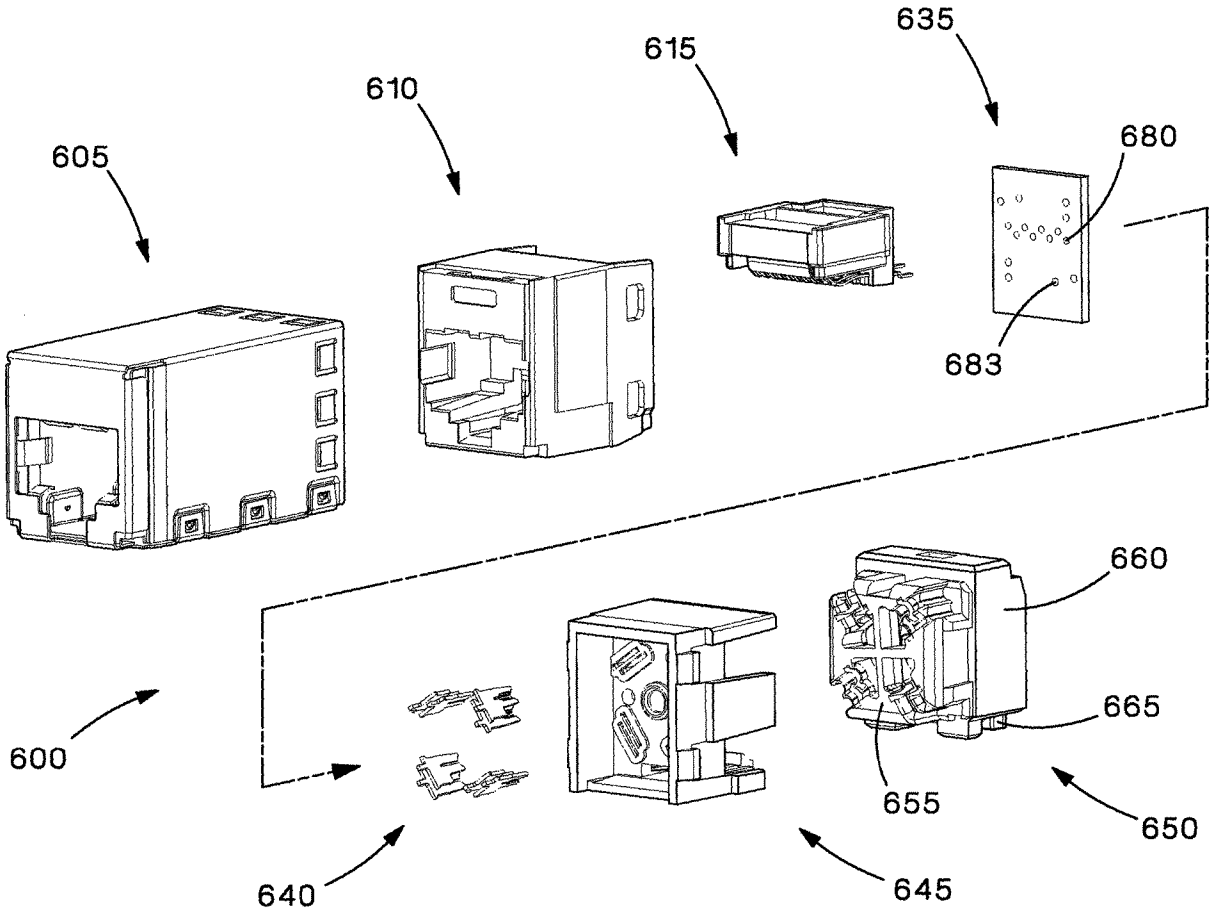
FIGS. 34-36 are isometric exploded views of a modified RJ45 jack according to an embodiment of the present invention.
Figure 35:
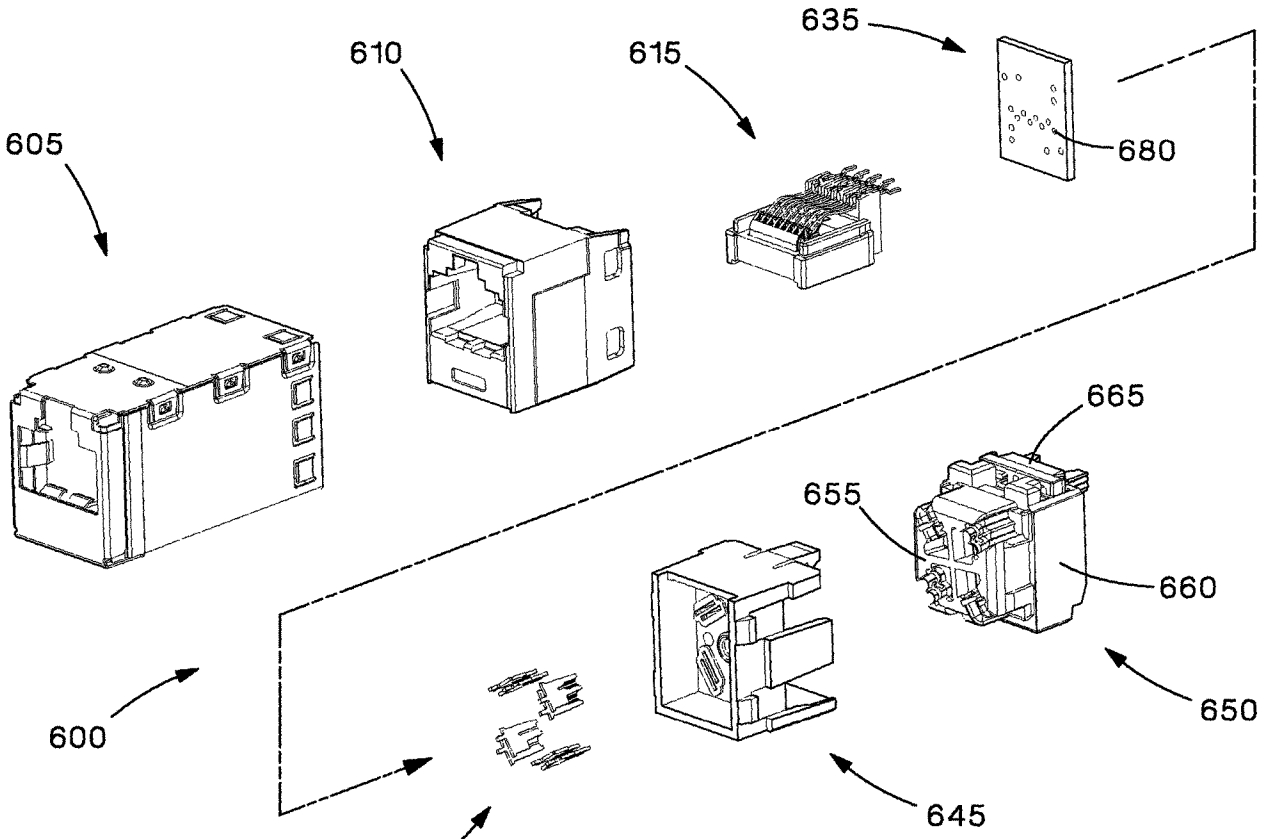
Figure 36:
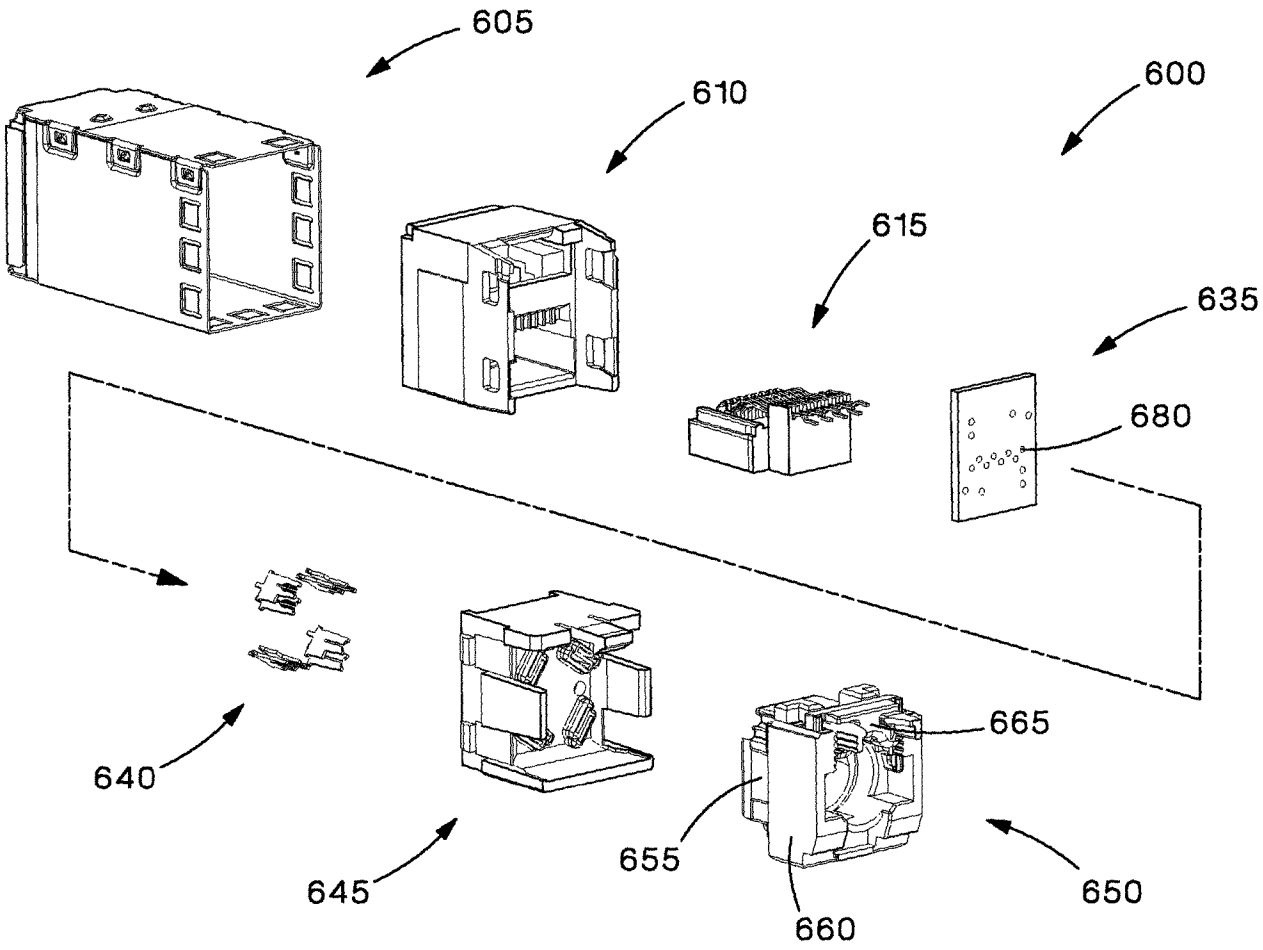

An alternate embodiment of the present invention is shown in FIG. 33 where an alternate embodiment of the modified RJ45 network jack 600 is shown to be mated with the modified network plug 115. As further illustrated in the exploded views provided in FIGS. 34-36, jack 600 includes conductive shield 605, jack housing 610, sled assembly 615 (which includes PICs 620, flexible PCB 622, flexible support 625, and sled holder 630), rigid PCB 635, IDCs 640, rear sled 645, and wire cap assembly 650 (which includes wire cap conductor holder 655, conductive wire cap back 660, and conductive strain relief clip 665. As with jack 110, jack 600 can be terminated to cable 125. A more-detailed view of the sled assembly 615 is shown in FIGS. 37 and 38, with an exploded view being shown in FIG. 39.

Figure 37:
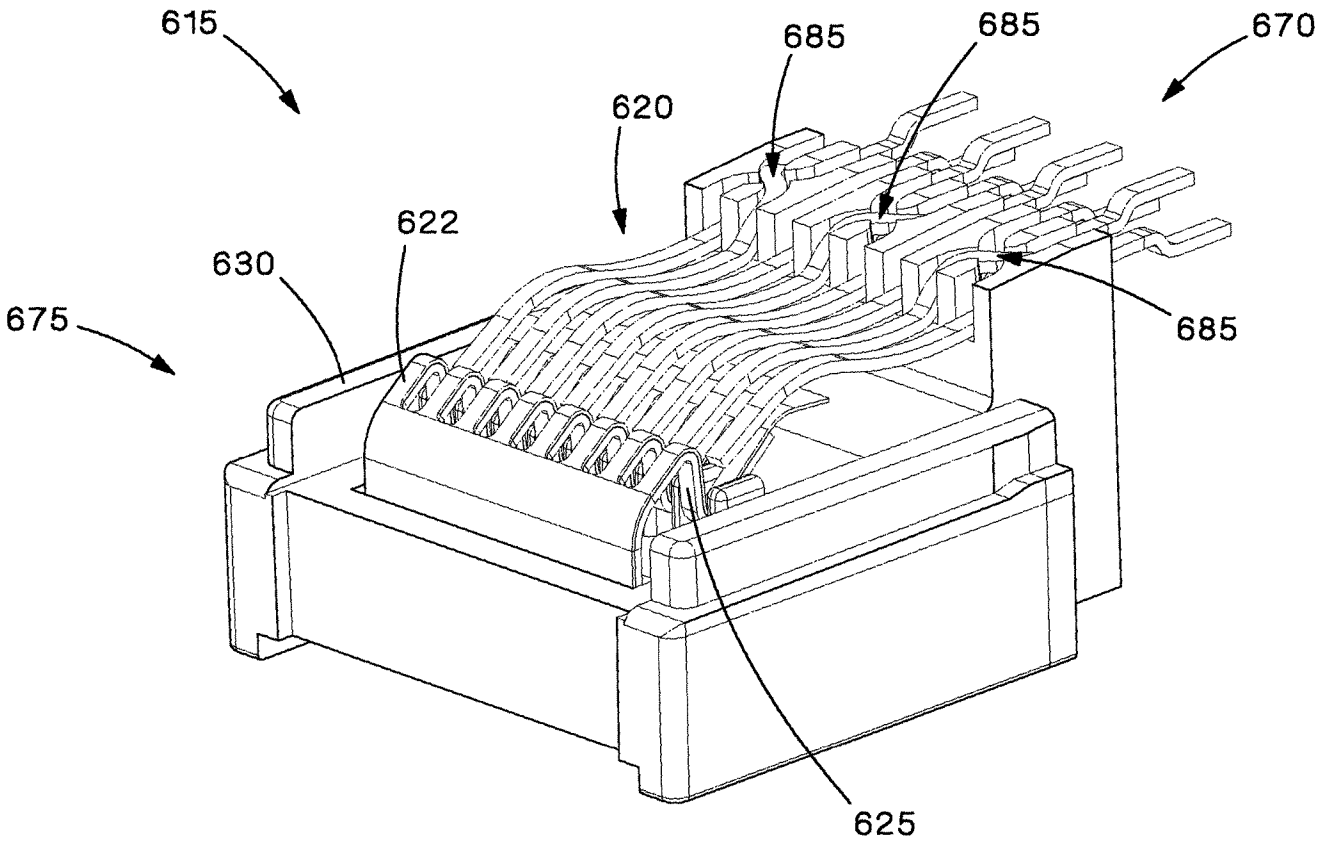
FIGS. 37-38 are isometric views of an embodiment of a sled assembly used in the modified RJ45 jack.
Figure 38:
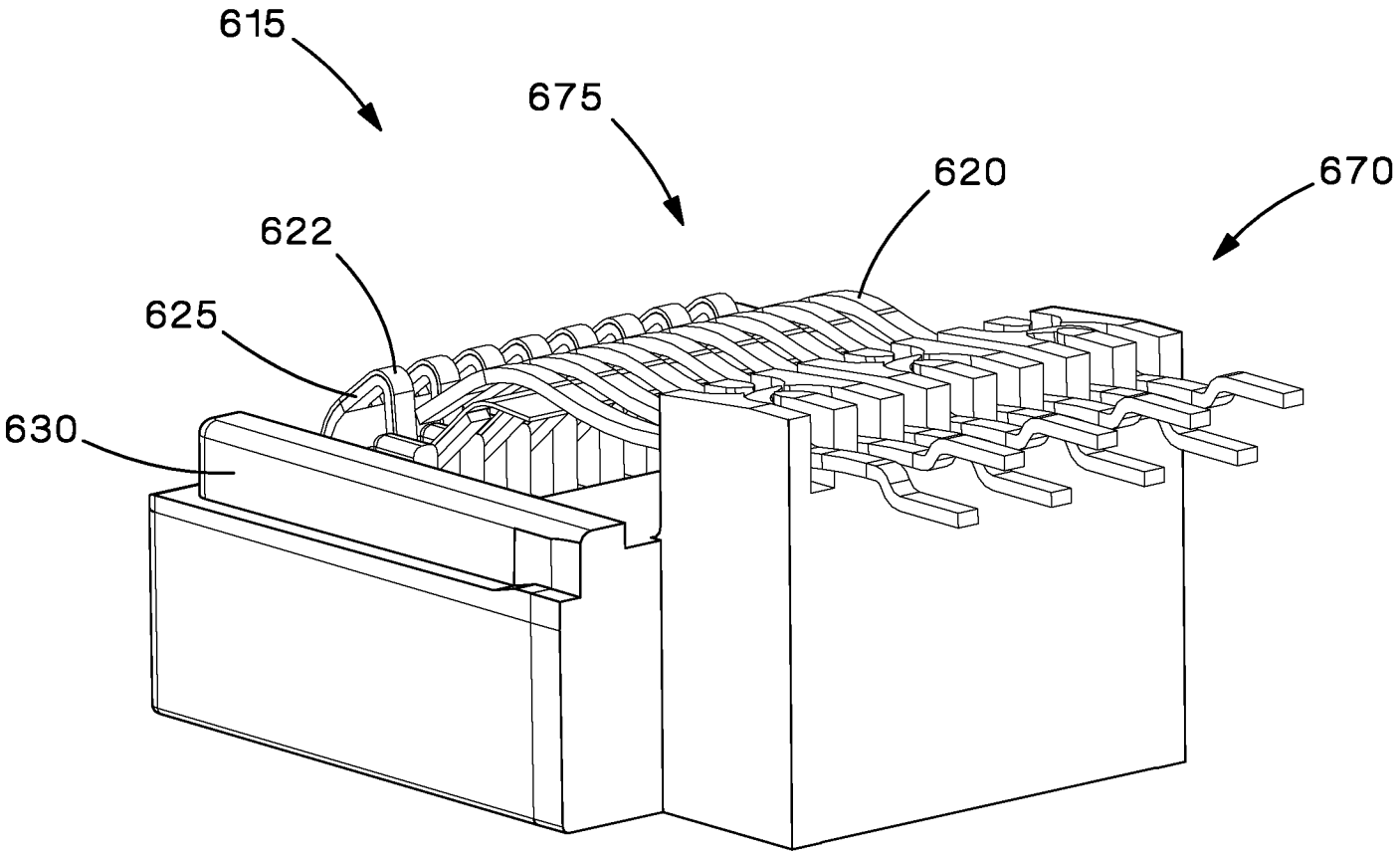
Figure 39:
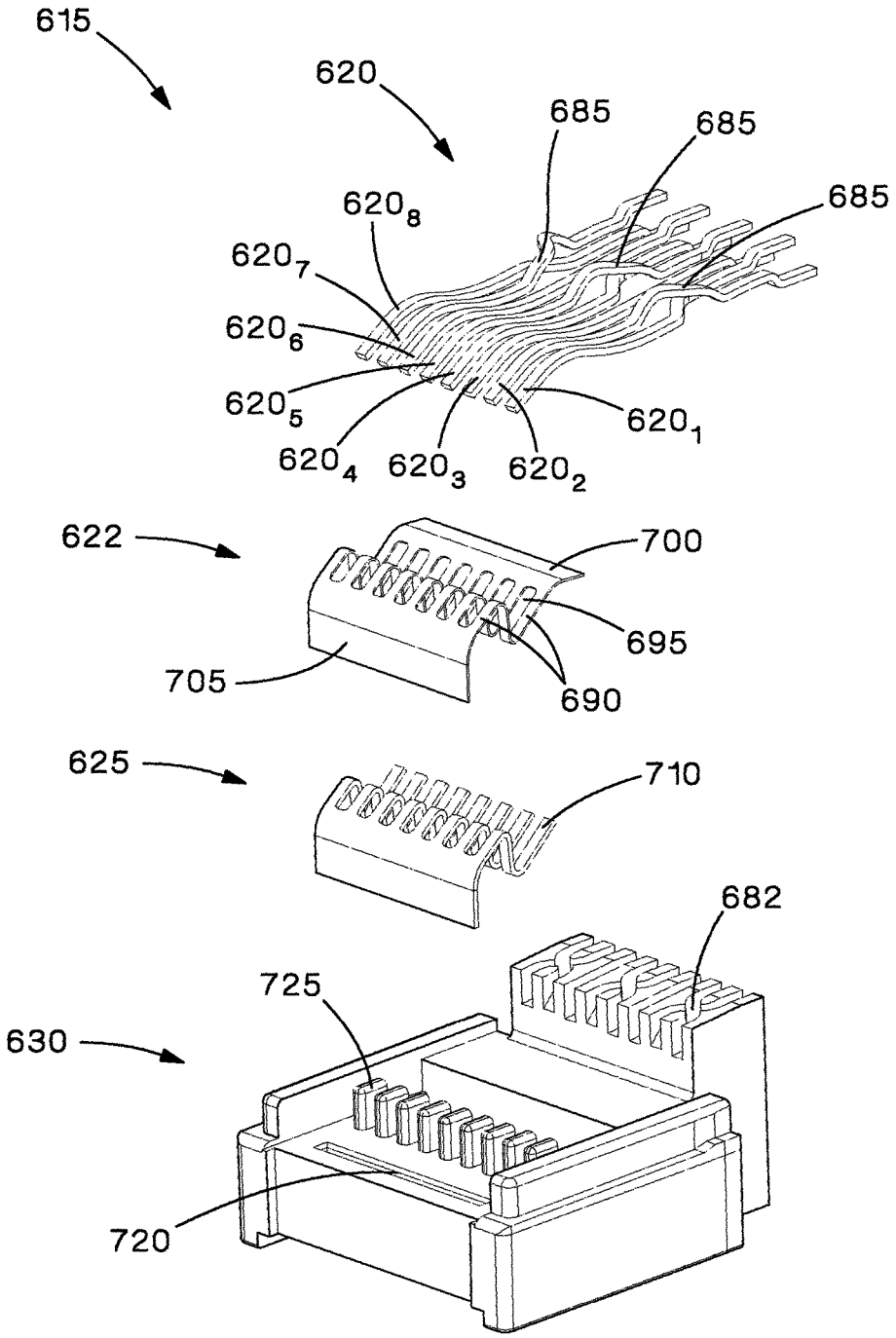
FIG. 39 is an isometric exploded view of the sled assembly of FIGS. 37-38.

As illustrated in FIGS. 37-39, each of the PICs 620 includes a first end 670 and a second end 675. First end 670 is secured in rigid PCB 635 by way of vias 680 (FIG. 34) and is further supported by support surfaces 682 such that each PIC is at least partially cantilevered. Near the first end 670 (in the region of the support surfaces 682), PICs 620 includes three crossovers 685. The first crossover occurs between PICs $\mathbf{620}_1$ and $\mathbf{620}_2$, the second crossover occurs between PICs $\mathbf{620}_4$ and $\mathbf{620}_5$, and the third crossover occurs between PICs $\mathbf{620}_7$ and $\mathbf{620}_8$. At the opposite end 675, each PIC can interface with a flexible PCB 622 that is supported by the flexible support 625.

For at least some PICs 620, the flexible PCB 622 includes contact pads/conductive traces 690 that come into contacts with the second end 675 of the respective PICs 620. In addition, contact pads/conductive traces 690 can serve to interface with plug contacts of modified RJ45 plug 115. While cutouts 695 provide clearance for the plug combs, contact pads/conductive traces 690 may converge near the top section 700 and/or near the bottom section 705 with circuitry that connects to the contact pads/conductive traces 690 being implemented in either one or both of these locations. This circuitry may be used for a wide variety of purposes including, for example, tuning for NEXT, FEXT, balance, return loss, etc. As such, crosstalk generating and/or compensating circuitry may be provided thereon.

Flexible PCB 622 is supported by flexible support 625 which has arms 710. This allows for individual flexure of each arm 710 to account for different plug contact locations or crimp heights. To secure flexible PCB 622 and flexible support 625 within the sled holder 630, said sled holder is provided with a slot 720. Flexible PCB 622 and flexible support 625 can be secured in place by press-fitting the pair into slot 720. Additional retention can be achieved by using an adhesive within slot 720. Furthermore, sled holder 630 includes combs 725 which help align arms 710 of flexible support 625.

In the assembly of the modified RJ45 network jack 600, IDCs 640 are electrically secured to rigid PCB 635 through a soldered connection through vias 683 (FIG. 34); however other non-limiting means of connecting IDCs 640 to rigid PCB 635 may be used. Thereafter, the sled assembly 615, rigid PCB 635, and IDCs 640 are all joined with the jack housing 610, and the remainder of the jack 600 is assembled in a manner that is similar/same to that of jack 110.

Figure 40:
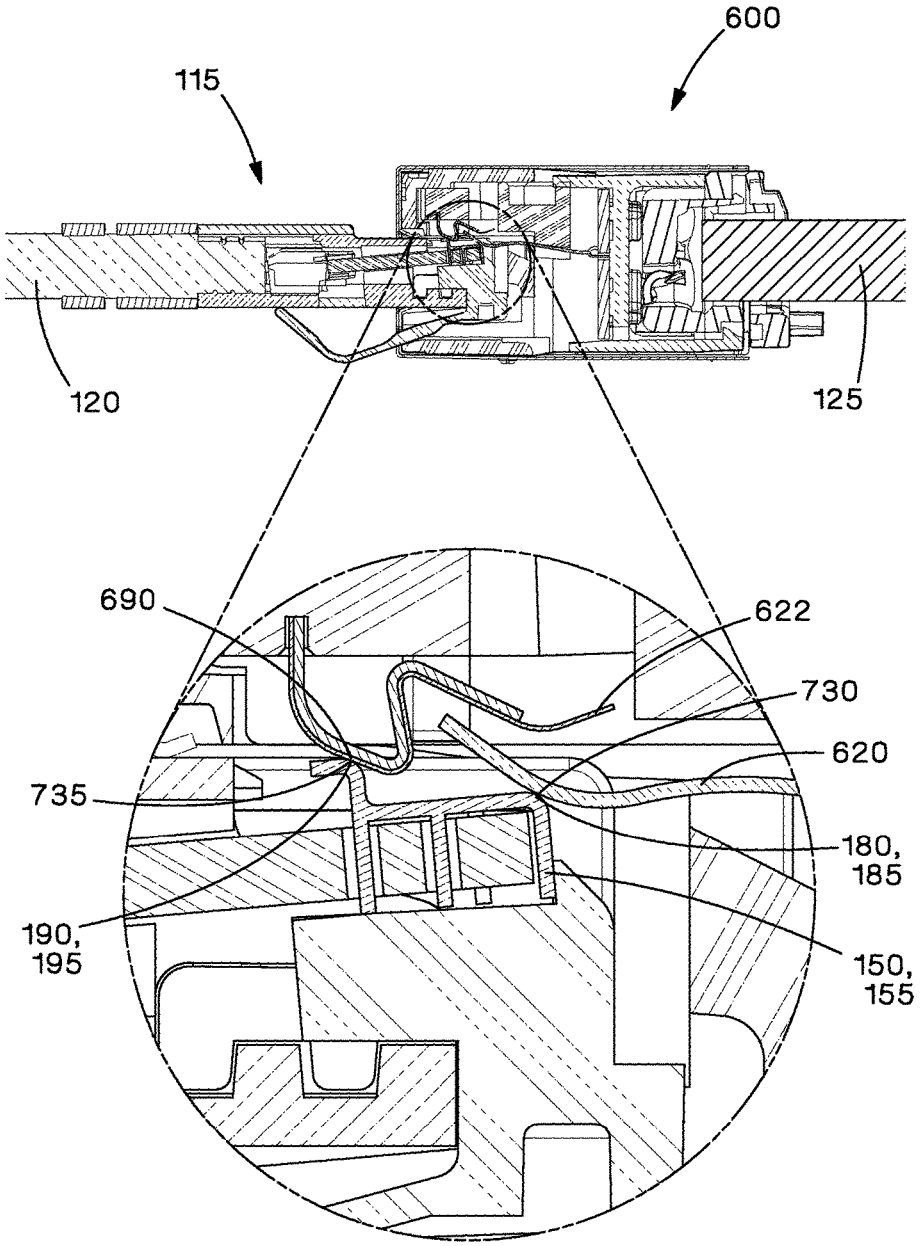
FIG. 40 is a cross-section view taken along section line 40-40 of FIG. 33 across the center of the mated assembly of modified RJ45 network jack and modified RJ45 plug.

FIG. 40 is a cross-section view taken along section line 40-40 of FIG. 33 across the center of the mated assembly of modified RJ45 network jack 600 and modified RJ45 plug assembly 115 with respective cables 125 and 120. When mated with the plug 115, there are two separate contact points 730 and 735 between each plug contact of the plug 115 and respective elements of the jack 600. The first contact point 730 is positioned such that it falls within the spatial range of the defined preferred electrical mating point for an IEC-60603-7:2010 connector, and occurs between the first mating surface 180/185 of the plug contacts 150/155 and the PICs 620. Since PICs 620 are electrically connected to cable 125 and plug contacts 150/155 are electrically connected to cable 120, first contact point 730 provides a current path between plug 115 and jack 600 and effectively becomes the plug/jack mating interface. The second contact point 735 is physically removed from the first contact point 730 and is positioned such that it falls outside the spatial range of the defined preferred electrical mating point for an IEC-60603-7:2010 connector. As such, second contact point 735 occurs between second mating surfaces 190/195 of the plug contacts 150/155 and the contact pads/conductive traces 690 of the flexible PCB 622.

Figure 41:
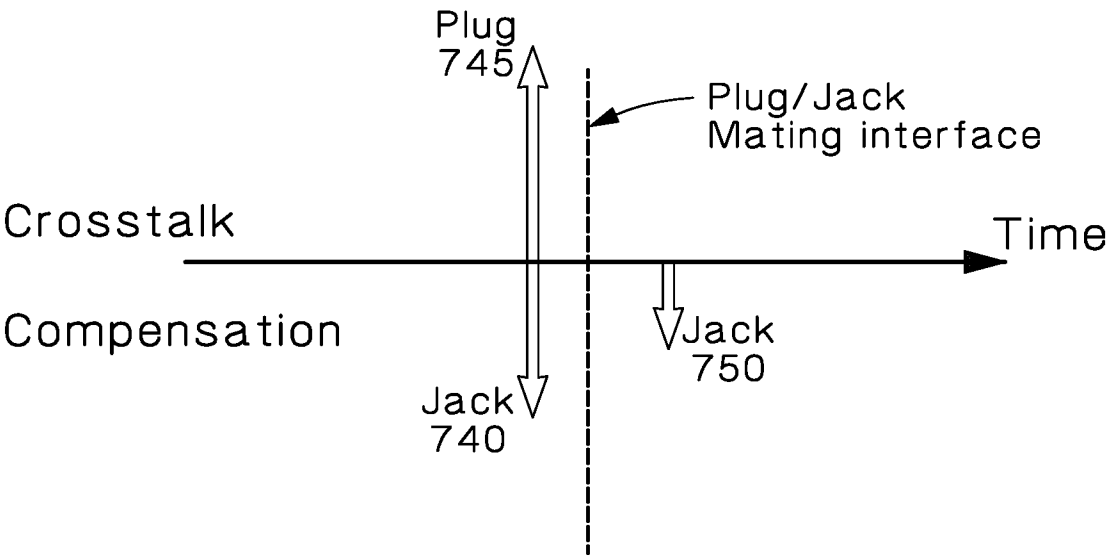
FIG. 41 is a vector diagram for lumped approximation of the signals generated by a mated plug/jack combination of FIG. 33 in accordance with an embodiment of the present invention.

Due to the physical layout of the plug contacts 150/155, PICs 620, and flexible PCB 622, there is no direct contact between the flexible PCB 622 and any of the PICs 620 when plug 115 is mated with the jack 600. This configuration, combined with the relatively short distance between crosstalk producing circuitry in the plug 115 and crosstalk cancelling circuitry on the flexible PCB 622, may allow the first stage of crosstalk compensation to occur prior to the effective plug/jack mating interface (which occurs effectively at contact point 730). FIG. 41 is a vector diagram for lumped approximation of the signals generated by a mated plug/jack combination of FIG. 33 in accordance with an embodiment of the present invention. This vector representation has one stage of compensation 740 approximately at the same point in time as that of crosstalk in the plug 745, prior to the plug/jack mating interface, with a second stage of compensation 750 after the plug/jack mating interface. The first stage of compensation 740 prior to the plug/jack mating interface is smaller in magnitude than the crosstalk of the plug 745 since that first element of compensation 740 is capacitive (this is because the compensation occurring on the flexible PCB 622 is off the current path). The second stage of compensation 750 is added to account for the inductive crosstalk portion of the compensation of the plug, and may be in PICs 620, rigid PCB 635, and/or IDCs 640. With first stage of compensation 740 being approximately 180° out of phase with the crosstalk 745 in the plug, this cancellation would be optimized for NEXT cancellation.

Figure 42:
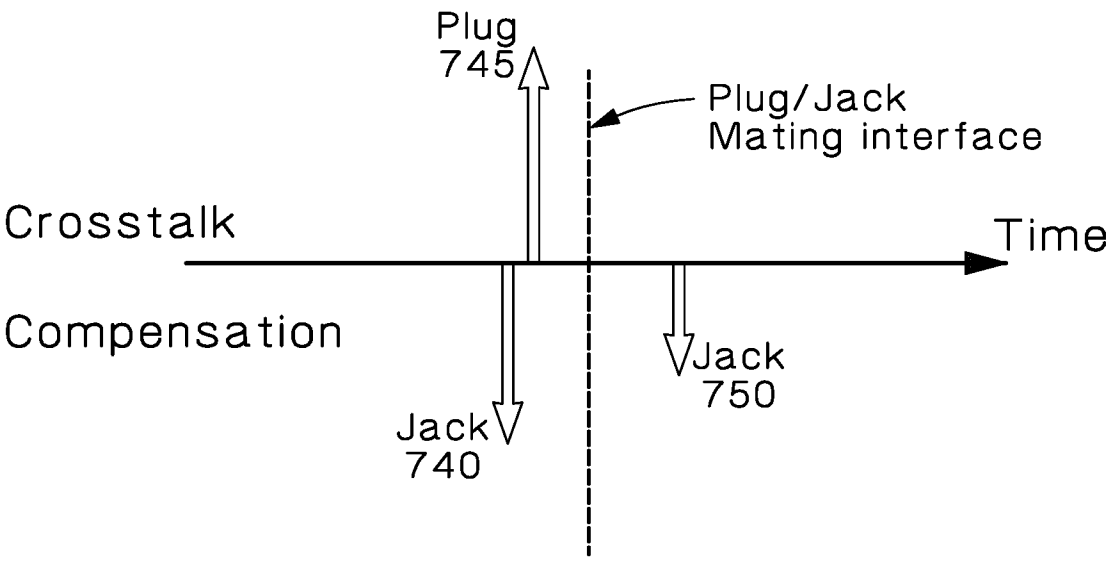
FIG. 42 is a vector diagram for lumped approximation of the signals generated by a mated plug/jack combination of FIG. 33 in accordance with an embodiment of the present invention.
Figure 43:
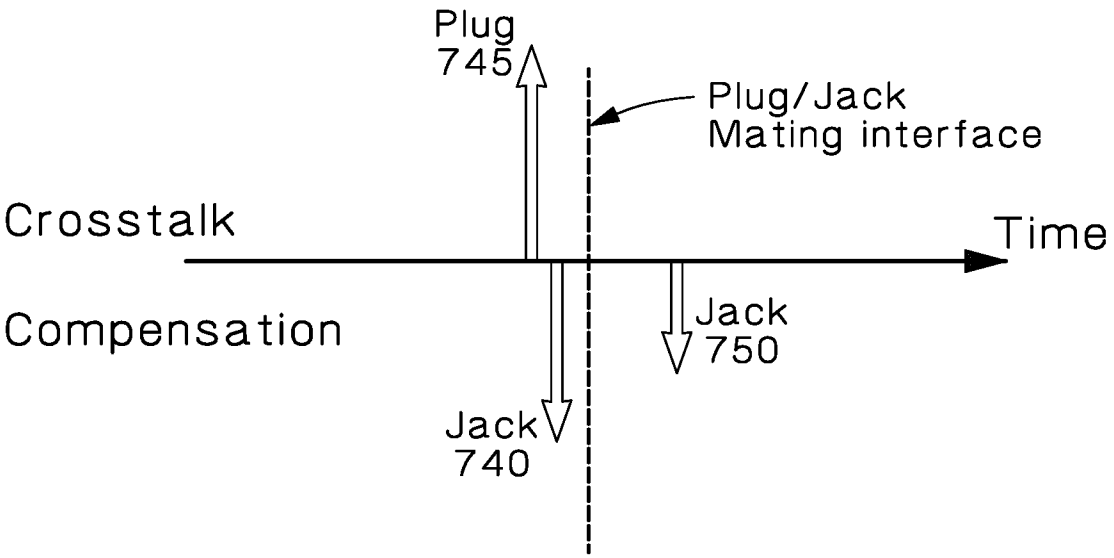
FIG. 43 is a vector diagram for lumped approximation of the signals generated by a mated plug/jack combination of FIG. 33 in accordance with an embodiment of the present invention.

While the vector representation depicted in FIG. 41 is an ideal phase cancellation with first stage of compensation 740 being approximately 180° out of phase with crosstalk 745 in the plug, in practice this may be difficult to realize. Accordingly, the phase of the compensation produced in the jack may shift in either direction. FIGS. 42 and 43 illustrate this occurrence. In FIG. 42, the first stage of compensation is shifted earlier in phase relative to the plug crosstalk 745 and in FIG. 43, the first stage of compensation 740 is shifted later (but still prior to the plug/jack mating interface) in phase relative to the plug crosstalk 745.

The occurrence of the first stage of crosstalk compensation prior to the effective plug/jack mating point can be particularly important since conventional RJ45 jacks typically provide crosstalk compensation after their respective plug/jack mating interface, thereby imposing a minimum distance between crosstalk generation and crosstalk cancellation circuitry that is at least as long as (and typically longer than) the distance from the crosstalk generation to the plug/jack mating interface. By reducing the distance between the crosstalk generation and crosstalk cancellation circuitry below that of the distance from the crosstalk generation to the plug/jack mating interface, at least some embodiments of the present invention may overcome the problem faced by conventional RJ45 jacks, and help improve the NEXT and FEXT performance of the mated plug/jack assembly. Another potential benefit of the mated configuration is that at the location of the second contacts surface the modified RJ45 plug does not have to comply with the crosstalk magnitude requirement of ANSI/TIA-568-C.2, and can be a much higher performing (lower crosstalk) RJ45 plug at the contact location. This may enable superior NEXT and FEXT cancellation ability.

Figure 44:
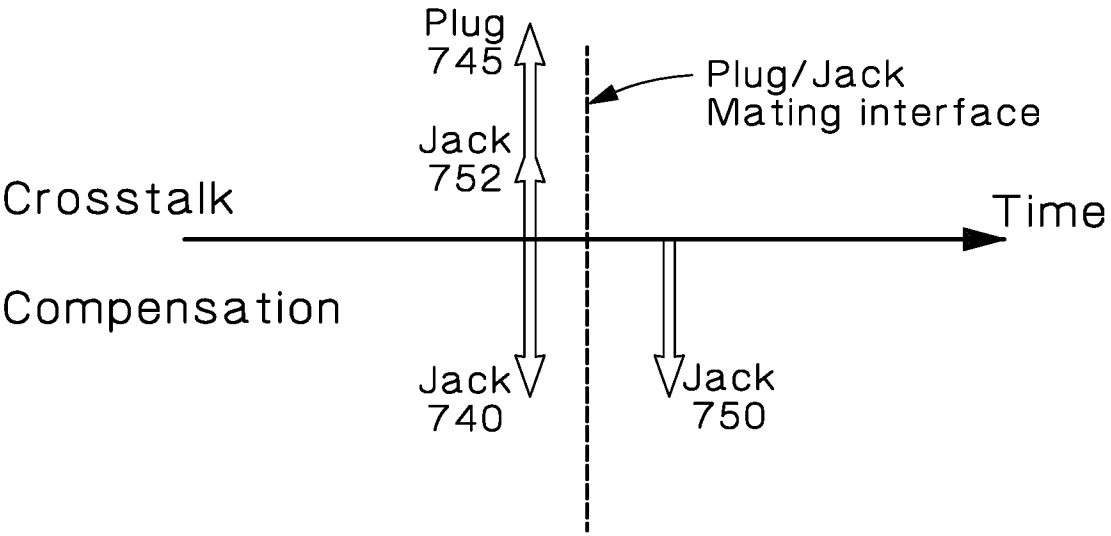
FIG. 44 is a vector diagram for lumped approximation of the signals generated by a mated plug/jack combination in accordance with an embodiment of the present invention.

While FIGS. 41-43 illustrate all of the offending crosstalk being produced within the plug, in an alternate embodiment, at least some of the offending crosstalk can be produced in the jack. FIG. 44 illustrates a vector diagram for lumped approximation of the signals generated by a mated plug/jack combination in accordance with such an embodiment of the present invention. As shown therein, an offending crosstalk jack stage 752 has been included prior to the plug/jack mating interface. Although typically a jack is meant to compensate a plug, there may be some instances where the injection of offending crosstalk in the jack could be beneficial for purposes such as, for example, improvement of balance. This offending crosstalk jack stage 752 can be realized via appropriate circuitry on the flexible PCB 622 and, as with the embodiments of FIGS. 42 and 43, it may not always be exactly contemporaneous with the plug crosstalk 752 and/or jack crosstalk 740. To compensate for the increased amount of offending crosstalk, the second stage of compensation 750 is depicted as being larger in magnitude.

Figure 45:
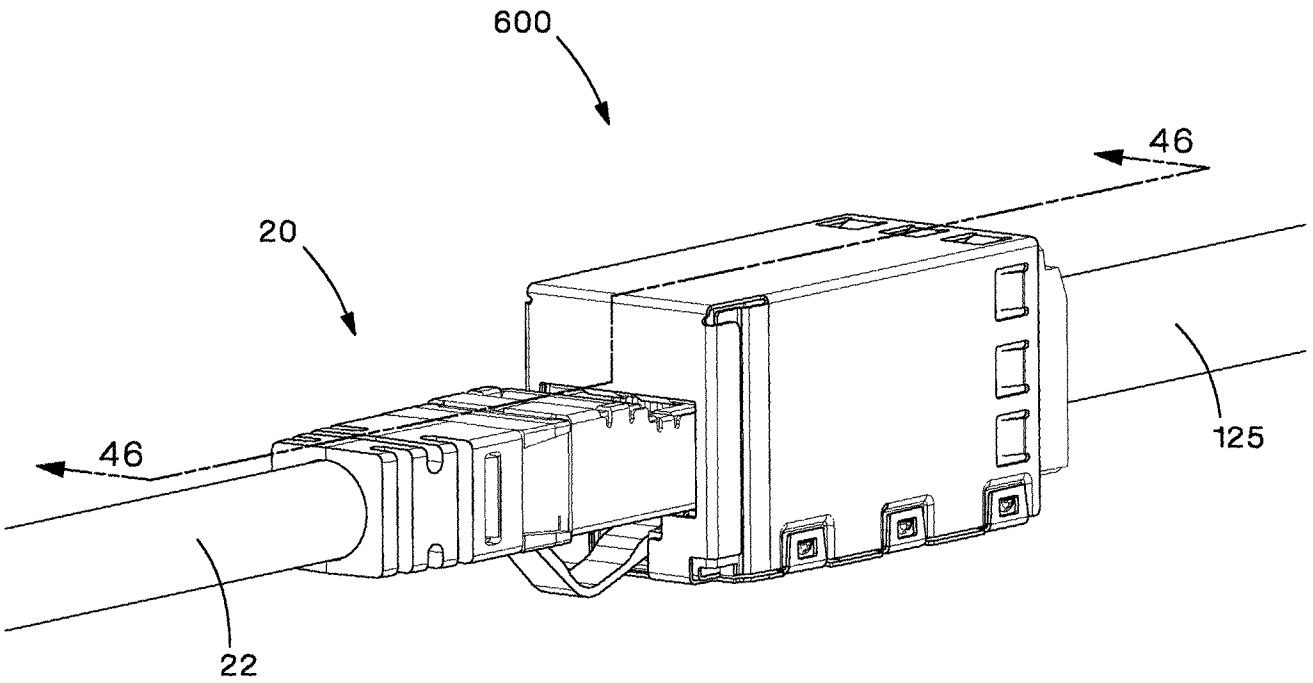
FIG. 45 is an isometric view of a modified RJ45 network jack mated with a conventional RJ45 network plug according to an embodiment of the present invention.
Figure 46:
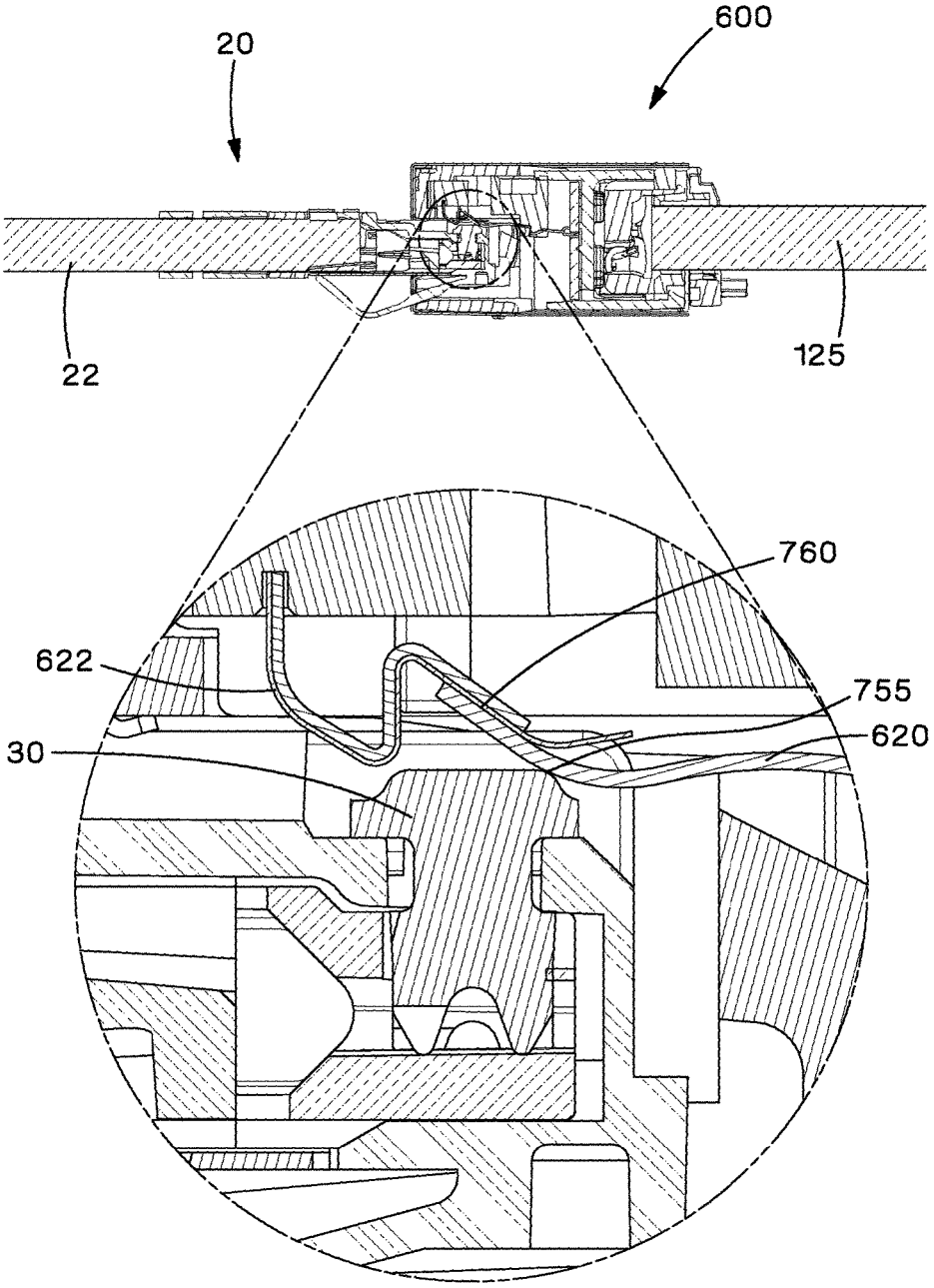
FIG. 46 is a cross-section view taken along section line 46-46 of FIG. 45 across the center of the mated assembly of modified RJ45 network jack and conventional RJ45 plug.

Referring now to FIG. 45, the same jack 600 can also be mated with a conventional RJ45 plug 20. A cross-section view taken along section line 46-46 of FIG. 45 across the center of this mated plug/jack 20/600 combination is also provided in FIG. 46. As shown therein contact point 755 is the electrical interface between PICs 620 and plug contacts 30. Contact point 755 is in the same relative position as contact point 55 (FIG. 1) and is approximately in the IEC-60603-7:2010 preferred electrical mating point location. Unlike when RJ45 network jack 600 and RJ45 plug 115 are mated, when RJ45 jack 600 is mated with a conventional RJ45 plug 20, there is no physical contact between any plug contacts 30 and flexible PCB 622. Instead, PICs 620 make physical contact with flexible PCB 622 at contact point 760. This, however, now occurs after the plug/jack mating interface which is effectively at the contact point 755.

Figure 47:
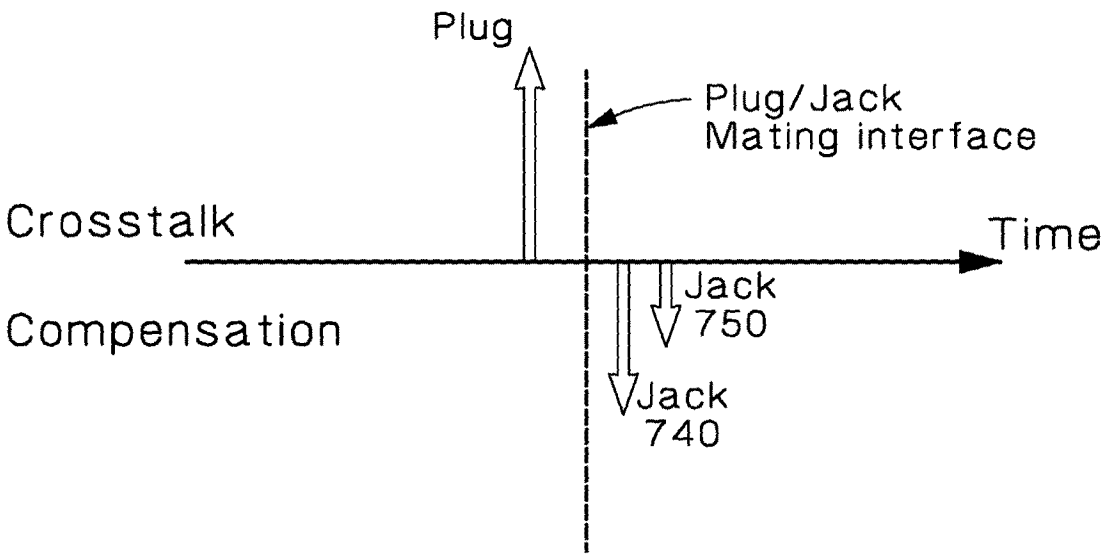
FIG. 47 is a vector diagram for lumped approximation of the signals generated by a mated plug/jack combination of FIG. 45 in accordance with an embodiment of the present invention.

FIG. 47 is a vector diagram for lumped approximation of the signals generated by a mated plug/jack combination of FIG. 45 in accordance with an embodiment of the present invention. This embodiment utilizes the same circuitry as the embodiment represented by the vector diagram in FIG. 41, however the first stage 740 of compensation is shifted in phase and now occurs after the plug/jack mating interface at contact point 755. The second stage of compensation 750 remains unchanged between the vector diagrams of FIG. 41 and FIG. 47.

Note that while this invention has been described in terms of several embodiments, these embodiments are non-limiting (regardless of whether they have been labeled as exemplary or not), and there are alterations, permutations, and equivalents, which fall within the scope of this invention. Furthermore, while references are made to a non-conventional RJ45 design (e.g., "modified" as used throughout this specification), the "RJ45" designation should not be viewed as limiting. In other words, while the modified RJ45 plugs and/or modified RJ45 jack provided in accordance with the present invention may embody some aspects of what is provided by the standard for an RJ45 connector, no one aspect should be viewed being required by the invention unless expressly specified by any of the claims that may be appended hereto. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

What is claim:

1. A communications plug, comprising:

a plug printed circuit board (PCB) included in a plug housing; and a first plurality of plug contacts and a plurality of second plug contacts each connected to the plug PCB, wherein:

each of the first and the second plurality of plug contacts includes a first mating surface to mate with a first type of communications jack and a second mating surface to mate with a second type of communications jack, the first mating surface is on a first end of the first and second plurality of plug contacts and the second mating surface is on a second end of the first and second plurality of plug contacts opposite the first end, the first end being closer to a plug nose of the communications plug than the second end, and the second mating surface is located further off of a surface of the plug PCB than first mating surface, wherein the first mating surface is to contact plug interface contacts (PICs) of the first type of communications jack when mated with the first type of communications jack, thereby establishing a first current path between the plug PCB and the first type of communications jack, the second mating surface is to contact PICs of the second type of communications jack when mated with second type of communications jack, thereby establishing a second current path between the plug PCB and the second type of communications jack, and the second current path is shorter than the first current path.

2. The communications plug of claim 1, wherein the second mating surface is off of the second current path when the first mating surface is mated to the first type of communications jack.

3. The communications plug of claim 2, wherein the first mating surface is off of the first current path when the second mating surface is mated to the second type of communications jack.

4. The communications plug of claim 1, wherein the first mating surface is at least 0.083 inches away from the second mating surface.

5. The communications plug of claim 1, wherein the first mating surface includes a first extension and the second mating surface includes a second extension, the first extension and the second extension to tune an amount of capacitive coupling that occurs between adjacent ones of the first and second pluralities of plug contacts.

6. The communications plug of claim 1, wherein the plug housing includes a left conductive shell, a right conductive shell, and a plug nose.

7. The communications plug of claim 1, wherein the communications plug is a RJ45 plug, the first type of communications jack is a first type of RJ45 jack, and the second type of communications jack is a second type of RJ45 jack.

* * * * *